US009930465B2

(12) United States Patent
Villemoes et al.

(10) Patent No.: US 9,930,465 B2
(45) Date of Patent: Mar. 27, 2018

(54) PARAMETRIC MIXING OF AUDIO SIGNALS

(71) Applicant: DOLBY INTERNATIONAL AB, Amsterdam Zuidoost (NL)

(72) Inventors: Lars Villemoes, Jarfalla (SE); Heiko Purnhagen, Sundyberg (SE); Heidi-Maria Lehtonen, Sollentuna (SE)

(73) Assignee: Dolby International AB, Amsterdam (NL)

( * ) Notice: Subject to any disclaimer, the term of this patent is extended or adjusted under 35 U.S.C. 154(b) by 0 days.

(21) Appl. No.: 15/522,255

(22) PCT Filed: Oct. 28, 2015

(86) PCT No.: PCT/EP2015/075022

§ 371 (c)(1),
(2) Date: Apr. 26, 2017

(87) PCT Pub. No.: WO2016/066705

PCT Pub. Date: May 6, 2016

(65) Prior Publication Data

US 2017/0332185 A1 Nov. 16, 2017

Related U.S. Application Data

(60) Provisional application No. 62/167,711, filed on May 28, 2015, provisional application No. 62/073,462, filed on Oct. 31, 2014.

(51) Int. Cl.
*H04S 3/00* (2006.01)
*G10L 19/008* (2013.01)

(52) U.S. Cl.
CPC ..... *H04S 3/008* (2013.01); *G10L 19/008* (2013.01); *H04S 2400/01* (2013.01); *H04S 2400/03* (2013.01); *H04S 2420/03* (2013.01)

(58) Field of Classification Search
None
See application file for complete search history.

(56) References Cited

U.S. PATENT DOCUMENTS 7,813,933 B2 10/2010 Martin
7,965,848 B2 6/2011 Villemoes
(Continued)

FOREIGN PATENT DOCUMENTS

TW 200636676 10/2006
TW 200910328 3/2009
(Continued)

OTHER PUBLICATIONS

Claypool, B. et al "Auro 11.1 versus Object-Based Sound in 3D" publication date: Unknown.
(Continued)

*Primary Examiner* — Paul Huber

(57) ABSTRACT

In an encoding section (100), a downmix section (110) forms first and second channels ($L_1$, $L_2$) of a downmix signal as linear combinations of first and second groups (401, 402) of channels, respectively, of an M-channel audio signal; and an analysis section (120) determines upmix parameters ($\alpha_{LU}$) for parametric reconstruction of the audio signal, and mixing parameters ($\alpha_{LM}$). In a decoding section (1200), a decorrelating section (1210) outputs a decorrelated signal (D) based on the downmix signal; and a mixing section (1220) determines mixing coefficients based on the mixing parameters or the upmix parameters, and forms a K-channel output signal ($\tilde{L}_1, \ldots, \tilde{L}_K$) as a linear combination of the downmix signal and the decorrelated signal in accordance with the mixing coefficients. The channels of the output signal approximate linear combinations of K groups (501-502, 1301-1303) of channels, respectively, of the audio signal. The K groups
(Continued)

constitute a different partition of the audio signal than the first and second groups, and $2 \leq K < M$.

20 Claims, 6 Drawing Sheets

(56) References Cited

U.S. PATENT DOCUMENTS

| | | | |
|---|---|---|---|
| 7,983,424 | B2 | 7/2011 | Kjorling |
| 8,488,797 | B2 | 7/2013 | Oh |
| 8,571,877 | B2 | 10/2013 | Engdegard |
| 2006/0106620 | A1 | 5/2006 | Thompson |
| 2006/0165184 | A1 | 7/2006 | Purnhagen |
| 2006/0165247 | A1 | 7/2006 | Mansfield |
| 2010/0166191 | A1 | 7/2010 | Herre |
| 2011/0022402 | A1 | 1/2011 | Engdegard |
| 2012/0020499 | A1 | 1/2012 | Neusinger |
| 2014/0211948 | A1 | 7/2014 | Hatanaka |
| 2016/0247514 | A1 | 8/2016 | Villemoes |

FOREIGN PATENT DOCUMENTS

| | | |
|---|---|---|
| WO | 2014/009878 | 1/2014 |
| WO | 2014/126689 | 8/2014 |

OTHER PUBLICATIONS

ISO/IEC JTC 1/SC 29 N "Information Technology—Coding of Audio-Visual Objects—Part 3: Audio, Amendment 4: New Levels for AAC Profiles" Oct. 19, 2012, pp. 1-26.

Capobianco, J. et al "Dynamic Strategy for Window Splitting, Parameters Estimation and Interpolation in Spatial Parametric Audio Coders" IEEE International Conference on Acoustics, Speech and Signal Processing, Mar. 25-30, 2012, pp. 1-4.

Herre, J. et al "MPEG Surround—The ISO/MPEG Standard for Efficient and Compatible Multichannel Audio Coding" AES, vol. 56, No. 11, Nov. 1, 2008, pp. 932-955.

PARAMETRIC MIXING OF AUDIO SIGNALS

TECHNICAL FIELD

The invention disclosed herein generally relates to encoding and decoding of audio signals, and in particular to mixing of channels of a downmix signal based on associated metadata.

BACKGROUND

Audio playback systems comprising multiple loudspeakers are frequently used to reproduce an audio scene represented by a multichannel audio signal, wherein the respective channels of the multichannel audio signal are played back on respective loudspeakers. The multichannel audio signal may for example have been recorded via a plurality of acoustic transducers or may have been generated by audio authoring equipment. In many situations, there are bandwidth limitations for transmitting the audio signal to the playback equipment and/or limited space for storing the audio signal in a computer memory or in a portable storage device. There exist audio coding systems for parametric coding of audio signals, so as to reduce the bandwidth or storage needed. On an encoder side, these systems typically downmix the multichannel audio signal into a downmix signal, which typically is a mono (one channel) or a stereo (two channels) downmix, and extract side information describing the properties of the channels by means of parameters like level differences and crosscorrelation. The downmix and the side information are then encoded and sent to a decoder side. On the decoder side, the multichannel audio signal is reconstructed, i.e. approximated, from the downmix under control of the parameters of the side information.

In view of the wide range of different types of devices and systems available for playback of multichannel audio content, including an emerging segment aimed at end-users in their homes, there is a need for new and alternative ways to efficiently encode multichannel audio content, so as to reduce bandwidth requirements and/or the required memory size for storage, facilitate reconstruction of the multichannel audio signal at a decoder side, and/or increase fidelity of the multichannel audio signal as reconstructed at a decoder side. There is also a need to facilitate playback of encoded multichannel audio content on different types of speaker systems, including systems with fewer speakers than the number of channels present in the original multichannel audio content.

BRIEF DESCRIPTION OF THE DRAWINGS

In what follows, example embodiments will be described in greater detail and with reference to the accompanying drawings, on which.

Figure 1:
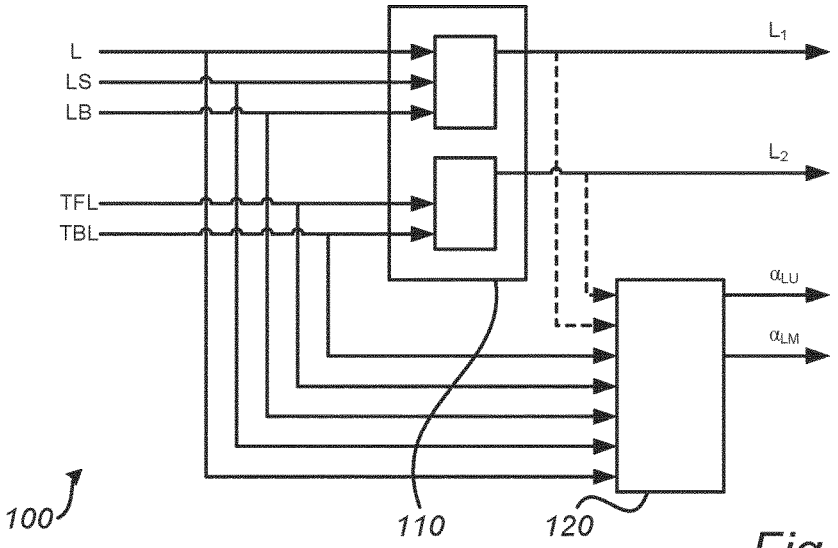
FIG. 1 is a generalized block diagram of an encoding section for encoding an M-channel signal as a two-channel downmix signal and associated metadata, according to an example embodiment.

All the figures are schematic and generally only show parts which are necessary in order to elucidate the invention, whereas other parts may be omitted or merely suggested.

DESCRIPTION OF EXAMPLE EMBODIMENTS

As used herein, an audio signal may be a standalone audio signal, an audio part of an audiovisual signal or multimedia signal or any of these in combination with metadata.

As used herein, a channel is an audio signal associated with a predefined/fixed spatial position/orientation or an undefined spatial position such as "left" or "right".

I. Overview—Decoder Side

According to a first aspect, example embodiments propose audio decoding systems, audio decoding methods and associated computer program products. The proposed decoding systems, methods and computer program products, according to the first aspect, may generally share the same features and advantages.

According to example embodiments, there is provided an audio decoding method which comprises receiving a two-channel downmix signal. The downmix signal is associated with metadata comprising upmix parameters for parametric reconstruction of an M-channel audio signal based on the downmix signal, where $M \geq 4$. A first channel of the downmix signal corresponds to a linear combination of a first group of one or more channels of the M-channel audio signal, and a second channel of the downmix signal corresponds to a linear combination of a second group of one or more channels of the M-channel audio signal. The first and second groups constitute a partition of the M channels of the M-channel audio signal. The audio decoding method further comprises: receiving at least a portion of the metadata; generating a decorrelated signal based on at least one channel of the downmix signal; determining a set of mixing coefficients based on the received metadata; and forming a two-channel output signal as a linear combination of the downmix signal and the decorrelated signal in accordance with the mixing coefficients. The mixing coefficients are determined such that a first channel of the output signal approximates a linear combination of a third group of one or more channels of the M-channel audio signal, and such that a second channel of the output signal approximates a linear combination of a fourth group of one or more channels of the M-channel audio signal. The mixing coefficients are also determined such that the third and fourth groups constitute a partition of the M channels of the M-channel audio signal, and such that both of the third and fourth groups comprise at least one channel from the first group.

The M-channel audio signal has been encoded as the two-channel downmix signal and the upmix parameters for parametric reconstruction of the M-channel audio signal. When encoding the M-channel audio signal on an encoder side, the coding format may be chosen e.g. for facilitating reconstruction of the M-channel audio signal from the downmix signal, for improving fidelity of the M-channel audio signal as reconstructed from the downmix signal, and/or for improving coding efficiency of the downmix signal. This choice of coding format may be performed by selecting the first and second groups and forming the channels of the downmix signals as respective linear combinations of the channels in the respective groups.

The inventors have realized that although the chosen coding format may facilitate reconstruction of the M-channel audio signal from the downmix signal, the downmix signal may not itself be suitable for playback using a particular two-speaker configuration. The output signal, corresponding to a different partition of the M-channel audio signal into the third and fourth groups, may be more suitable for a particular two-channel playback setting than the downmix signal. Providing the output signal based on the downmix signal and the received metadata may therefore improve two-channel playback quality as perceived by a listener, and/or improve fidelity of the two-channel playback to a sound field represented by the M-channel audio signal.

The inventors have further realized that, instead of first reconstructing the M-channel audio signal from the downmix signal and then generating an alternative two-channel representation of the M-channel audio signal (e.g. by additive mixing), the alternative two-channel representation provided by the output signal may be more efficiently generated from the downmix signal and the received metadata by exploiting the fact that some channels of the M-channel audio signal are grouped together similarly in both of the two-channel representations. Forming the output signal as a linear combination of the downmix signal and the decorrelated signal may for example reduce computational complexity at the decoder side and/or reduce the number of components or processing steps employed to obtain an alternative two-channel representation of the M-channel audio signal.

The first channel of the downmix signal may for example have been formed, e.g. on an encoder side, as a linear combination of the first group of one or more channels. Similarly, the second channel of the downmix signal may for example have been formed, on an encoder side, as a linear combination of the second group of one or more channels.

The channels of the M-channel audio signal may for example form a subset of a larger number of channels together representing a sound field.

It will be appreciated that since both of the third and fourth groups comprise at least one channel from the first group, the partition provided by the third and fourth groups is different than the partition provided by the first and second groups.

The decorrelated signal serves to increase the dimensionality of the audio content of the downmix signal, as perceived by a listener. Generating the decorrelated signal may for example include applying a linear filter to one or more channels of the downmix signal.

Forming the output signal may for example include applying at least some of the mixing coefficients to the channels of the downmix signal, and at least some of the mixing coefficients to the one or more channels of the decorrelated signal.

In an example embodiment, the received metadata may include the upmix parameters, and the mixing coefficients may be determined by processing the upmix parameters, e.g. by performing mathematical operations (e.g. including arithmetic operations) on the upmix parameters. Upmix parameters are typically already determined on an encoder side and provided together with the downmix signal for parametric reconstruction of the M-channel audio signal on a decoder side. The upmix parameters carry information about the M-channel audio signal which may be employed for providing the output signal based on the downmix signal. Determining, on the decoder side, the mixing coefficients based on the upmix parameters reduces the need for additional metadata to be generated at the encoder side and allows for a reduction of the data transmitted from the encoder side.

In an example embodiment, the received metadata may include mixing parameters distinct from the upmix parameters. In the present example embodiment, the mixing coefficients may be determined based on the received metadata and thereby based on the mixing parameters. The mixing parameters may be determined already at the encoder side and transmitted to the decoder side for facilitating determination of the mixing coefficients. Moreover, the use of mixing parameters to determine the mixing coefficients allows for control of the mixing coefficients from the encoder side. Since the original M-channel audio signal is available at the encoder side, the mixing parameters may for example be tuned at the encoder side so as to increase fidelity of the two-channel output signal as a two-channel representation of the M-channel audio signal. The mixing parameters may for example be the mixing coefficients themselves, or the mixing parameters may provide a more compact representation of the mixing coefficients. The mixing coefficients may for example be determined by processing the mixing parameters, e.g. according to a predefined rule. The mixing parameters may for example include three independently assignable parameters.

In an example embodiment, the mixing coefficients may be determined independently of any values of the upmix parameters, which allows for tuning of the mixing coefficients independently of the upmix parameters, and allows for increasing the fidelity of the two-channel output signal as a two-channel representation of the M-channel audio signal.

In an example embodiment, it may hold that M=5, i.e. the M-channel audio signal may be a five-channel audio signal. The audio decoding method of the present example embodiment may for example be employed for the five regular channels of one of the currently established 5.1 audio formats, or for five channels on the left or right hand side in an 11.1 multichannel audio signal. Alternatively, it may hold that M=4, or M≥6.

In an example embodiment, each gain which controls a contribution from a channel of the M-channel audio signal to one of the linear combinations, to which the channels of the downmix signal correspond, may coincide with a gain controlling a contribution from the channel of the M-channel audio signal to one of the linear combinations approximated by the channels of the output signal. The fact that these gains coincide in the present example embodiment allows for simplifying the provision of the output signal based on the downmix signal. In particular, it is possible to reduce the number of decorrelated channels employed for approximating the linear combinations of the third and fourth groups based on the downmix signal.

Different gains may for example be employed for different channels of the M-channel audio signal.

In a first example, all the gains may have the value 1. In the first example, the first and second channels of the downmix signal may correspond to non-weighted sums of the first and second groups, respectively, and the first and second channels of the output signal may approximate non-weighted sums of the third and fourth sets, respectively.

In a second example, at least some of the gains may have different values than 1. In the second example, the first and second channels of the downmix signal may correspond to weighted sums of the first and second groups, respectively, and the first and second channels of the output signal may approximate weighted sums of the third and fourth sets, respectively.

In an example embodiment, the decoding method may further comprise: receiving a bitstream representing the downmix signal and the metadata; and extracting, from the bitstream, the downmix signal and the received portion of the metadata. In other words, the received metadata employed for determining the mixing coefficients may first have been extracted from the bitstream. All of the metadata, including the upmix parameters, may for example be extracted from the bitstream. In an alternative example, only metadata necessary to determine the mixing coefficients may be extracted from the bitstream, and extraction of further metadata may for example be inhibited.

In an example embodiment, the decorrelated signal may be a single-channel signal and the output signal may be formed by including no more than one decorrelated signal channel into the linear combination of the downmix signal and the decorrelated signal, i.e. into the linear combination from which the output signal is obtained. The inventors have realized that there is no need to reconstruct the M-channel audio signal in order to provide the two-channel output signal, and that since the full M-channel audio signal need not be reconstructed, the number of decorrelated signal channels may be reduced.

In an example embodiment, the mixing coefficients may be determined such that the two channels of the output signal receive contributions of equal magnitude (e.g. equal amplitude) from the decorrelated signal. The contributions from the decorrelated signal to the respective channel of the output signal may have opposite signs. In other words, the mixing coefficients may be determined such that a sum of a mixing coefficient controlling a contribution from a channel of the decorrelated signal to the first channel of the output signal, and a mixing coefficient controlling a contribution from the same channel of the decorrelated signal to the second channel of the output signal, has the value 0.

In the present example embodiment, the amount (e.g. amplitude) of audio content originating from decorrelated signal (i.e. audio content for increasing the dimensionality of the downmix signal) may for example be equal in both channels of the output signal.

In an example embodiment, forming the output signal may amount to a projection from three channels to two channels, i.e. a projection from the two channels of the downmix signal and one decorrelated signal channel to the two channels of the output signal. For example, the output signal may be directly obtained as a linear combination of the downmix signal and the decorrelated signal without first reconstructing the full M channels of the M-channel audio signal.

In an example embodiment, the mixing coefficients may be determined such that a sum of a mixing coefficient controlling a contribution from the first channel of the downmix signal to the first channel of the output signal, and a mixing coefficient controlling a contribution from the first channel of the downmix signal to the second channel of the output signal, has the value one. In particular, one of the mixing coefficients is derivable from the upmix parameters (e.g., sent as an explicit value or obtainable from the upmix parameters after performing computations on a compact representation, as explained in other sections of this disclosure) and the other can be readily computed by requiring the sum of both mixing coefficients to be equal to one.

Additionally, or alternatively, the mixing coefficients may be determined such that a sum of a mixing coefficient controlling a contribution from the second channel of the downmix signal to the first channel of the output signal, and a mixing coefficient controlling a contribution from the second channel of the downmix signal to the second channel of the output signal, has the value one.

In an example embodiment, the first group may consist of two or three channels. A channel of the downmix signal corresponding to a linear combination of two or three channels, rather than corresponding to a linear combination of four or more channels, may increase fidelity of the M-channel audio signal as reconstructed by a decoder performing parametric reconstruction of all M channels. The decoding method of the present example embodiment may be compatible with such a coding format.

In an example embodiment, the M-channel audio signal may comprise three channels representing different horizontal directions in a playback environment for the M-channel audio signal, and two channels representing directions vertically separated from those of the three channels in the playback environment. In other words, the M-channel audio signal may comprise three channels intended for playback by audio sources located at substantially the same height as a listener (or a listener's ear) and/or propagating substantially horizontally, and two channels intended for playback by audio sources located at other heights and/or propagating (substantially) non-horizontally. The two channels may for example represent elevated directions.

In an example embodiment, the first group may consist of the three channels representing different horizontal directions in a playback environment for the M-channel audio signal, and the second group may consist of the two channels representing directions vertically separated from those of the three channels in the playback environment. The vertical partition of the M-channel audio signal provided by the first and second groups in the present example embodiment may increase fidelity of the M-channel audio signal as reconstructed by a decoder performing parametric reconstruction of all M channels, e.g. in cases where the vertical dimension is important for the overall impression of the sound field represented by the M-channel audio signal. The decoding method of the present example embodiment may be compatible with a coding format providing this vertical partition.

In an example embodiment, one of the third and fourth groups may comprise both of the two channels representing directions vertically separated from those of the three channels in the playback environment. Alternatively, each of the third and fourth groups may comprise one of the two channels representing directions vertically separated from those of the three channels in the playback environment, i.e. the third and fourth groups may comprise one each of these two channels.

In an example embodiment, the decorrelated signal may be obtained by processing a linear combination of the channels of the downmix signal, e.g. including applying a linear filter to the linear combination of the channels of the downmix signal channels. Alternatively, the decorrelated signal may be obtained based on no more than one of the channels of the downmix signal, e.g. by processing a channel of the downmix signal (e.g. including applying a linear filter). If for example the second group of channels consists of a single channel and the second channel of the downmix signal corresponds to this single channel, then the decorrelated signal may for example be obtained by processing only the first channel of the downmix signal.

In an example embodiment, the first group may consist of N channels, where N≥3, and the first group may be reconstructable as a linear combination of the first channel of the downmix signal and an (N−1)-channel decorrelated signal by applying upmix coefficients of a first type, referred to herein as dry upmix coefficients, to the first channel of the downmix signal and upmix coefficients of a second type, referred to herein as wet upmix coefficients, to channels of the (N−1)-channel decorrelated signal. In the present example embodiment, the received metadata may include upmix parameters of a first type, referred to herein as dry upmix parameters, and upmix parameters of a second type, referred to herein as wet upmix parameters. Determining the mixing coefficients may comprise: determining, based on the dry upmix parameters, the dry upmix coefficients; populating an intermediate matrix having more elements than the number of received wet upmix parameters, based on the received wet upmix parameters and knowing that the intermediate matrix belongs to a predefined matrix class; obtaining the wet upmix coefficients by multiplying the intermediate matrix by a predefined matrix, wherein the wet upmix coefficients correspond to the matrix resulting from the multiplication and includes more coefficients than the number of elements in the intermediate matrix; and processing the wet and dry upmix coefficients.

In the present example embodiment, the number of wet upmix coefficients for reconstructing the first group of channels is larger than the number of received wet upmix parameters. By exploiting knowledge of the predefined matrix and the predefined matrix class to obtain the wet upmix coefficients from the received wet upmix parameters, the amount of information needed for parametric reconstruction of the first group of channels may be reduced, allowing for a reduction of the amount of metadata transmitted together with the downmix signal from an encoder side. By reducing the amount of data needed for parametric reconstruction, the required bandwidth for transmission of a parametric representation of the M-channel audio signal, and/or the required memory size for storing such a representation may be reduced.

The (N−1)-channel decorrelated signal may be generated based on the first channel of the downmix signal and serves to increase the dimensionality of the content of the reconstructed first group of channels, as perceived by a listener.

The predefined matrix class may be associated with known properties of at least some matrix elements which are valid for all matrices in the class, such as certain relationships between some of the matrix elements, or some matrix elements being zero. Knowledge of these properties allows for populating the intermediate matrix based on fewer wet upmix parameters than the full number of matrix elements in the intermediate matrix. The decoder side has knowledge at least of the properties of, and relationships between, the elements it needs to compute all matrix elements on the basis of the fewer wet upmix parameters.

How to determine and employ the predefined matrix and the predefined matrix class is described in more detail on page 16, line 15 to page 20, line 2 in U.S. provisional patent application No. 61/974,544; first named inventor: Lars Villemoes; filing date: 3 Apr. 2014. See in particular equation (9) therein for examples of the predefined matrix.

In an example embodiment, the received metadata may include N(N−1)/2 wet upmix parameters. In the present example embodiment, populating the intermediate matrix may include obtaining values for $(N-1)^2$ matrix elements based on the received N(N−1)/2 wet upmix parameters and knowing that the intermediate matrix belongs to the predefined matrix class. This may include inserting the values of the wet upmix parameters immediately as matrix elements, or processing the wet upmix parameters in a suitable manner for denying values for the matrix elements. In the present example embodiment, the predefined matrix may include N(N−1) elements, and the set of wet upmix coefficients may include N(N−1) coefficients. For example, the received metadata may include no more than N(N−1)/2 independently assignable wet upmix parameters and/or the number of wet upmix parameters may be no more than half the number of wet upmix coefficients for reconstructing the first group of channels.

In an example embodiment, the received metadata may include (N−1) dry upmix parameters. In the present example embodiment, the dry upmix coefficients may include N coefficients, and the dry upmix coefficients may be determined based on the received (N−1) dry upmix parameters and based on a predefined relation between the dry upmix coefficients. For example, the received metadata may include no more than (N−1) independently assignable dry upmix parameters.

In an example embodiment, the predefined matrix class may be one of: lower or upper triangular matrices, wherein known properties of all matrices in the class include predefined matrix elements being zero; symmetric matrices, wherein known properties of all matrices in the class include predefined matrix elements (on either side of the main diagonal) being equal; and products of an orthogonal matrix and a diagonal matrix, wherein known properties of all matrices in the class include known relations between predefined matrix elements. In other words, the predefined matrix class may be the class of lower triangular matrices, the class of upper triangular matrices, the class of symmetric matrices or the class of products of an orthogonal matrix and a diagonal matrix. A common property of each of the above classes is that its dimensionality is less than the full number of matrix elements.

In an example embodiment, the decoding method may further comprise: receiving signaling indicating (a selected) one of at least two coding formats of the M-channel audio signal, the coding formats corresponding to respective different partitions of the channels of the M-channel audio signal into respective first and second groups associated with the channels of the downmix signal. In the present example embodiment, the third and fourth groups may be predefined, and the mixing coefficients may be determined such that a single partition of the M-channel audio signal into the third and fourth groups of channels, approximated by the channels of the output signal, is maintained for (i.e. is common to) the at least two coding formats.

In the present example embodiment, the decorrelated signal may for example be determined based on the indicated coding format and on at least one channel of the downmix signal.

In the present example embodiment, the at least two different coding formats may have been employed at the encoder side when determining the downmix signal and the metadata, and the decoding method may handle differences between the coding formats by adjusting the mixing coefficients, and optionally also the decorrelated signal. In case a switch is detected from a first coding format to a second coding format, the decoding method may for example include performing interpolation from mixing parameters associated with the first coding format to mixing parameters associated with the second coding format.

In an example embodiment, the decoding method may further comprise: passing the downmix signal through as the output signal, in response to the signaling indicating a particular coding format. In the present example embodiment, the particular coding format may correspond to a partition of the channels of the M-channel audio signal coinciding with a partition which the third and fourth groups define. In the present example embodiment, the partition provided by the channels of the downmix signal may coincide with the partition to be provided by the channels of the output signal, and there may be no need to process the downmix signal. The downmix signal may therefore be passed through as the output signal In an example embodiment, the decoding method may comprise: suppressing the contribution from the decorrelated signal to the output signal, in response to the signaling indicating a particular coding format. In the present example embodiment, the particular coding format may correspond to a partition of the channels of the M-channel audio signal coinciding with a partition which the third and fourth groups define. In the present example embodiment, the partition provided by the channels of the downmix signal may coincide with the partition to be provided by the channels of the output signal, and there may be no need for decorrelation.

In an example embodiment, in a first coding format, the first group may consist of three channels representing different horizontal directions in a playback environment for the M-channel audio signal, and the second group of channels may consist of two channels representing directions vertically separated from those of the three channels in the playback environment. In a second coding format, each of the first and second groups may comprise one of the two channels.

According to example embodiments, there is provided an audio decoding system comprising a decoding section configured to receive a two-channel downmix signal. The downmix signal is associated with metadata comprising upmix parameters for parametric reconstruction of an M-channel audio signal based on the downmix signal, where $M \geq 4$. A first channel of the downmix signal corresponds to a linear combination of a first group of one or more channels of the M-channel audio signal, and a second channel of the downmix signal corresponds to a linear combination of a second group of one or more channels of the M-channel audio signal. The first and second groups constitute a partition of the M channels of the M-channel audio signal. The decoding section is further configured to: receive at least a portion of the metadata; and provide a two-channel output signal based on the downmix signal and the received metadata. The decoding section comprises a decorrelating section configured to receive at least one channel of the downmix signal and to output, based thereon, a decorrelated signal. The decoding section further comprises a mixing section configured to: determine a set of mixing coefficients based on the received metadata, and form the output signal as a linear combination of the downmix signal and the decorrelated signal in accordance with the mixing coefficients. The mixing section is configured to determine the mixing coefficients such that a first channel of the output signal approximates a linear combination of a third group of one or more channels of the M-channel audio signal, and such that a second channel of the output signal approximates a linear combination of a fourth group of one or more channels of the M-channel audio signal. The mixing section is further configured to determine the mixing coefficients such that the third and fourth groups constitute a partition of the M channels of the M-channel audio signal, and such that both of the third and fourth groups comprise at least one channel from the first group.

In an example embodiment, the audio decoding system may further comprise an additional decoding section configured to receive an additional two-channel downmix signal. The additional downmix signal may be associated with additional metadata comprising additional upmix parameters for parametric reconstruction of an additional M-channel audio signal based on the additional downmix signal. A first channel of the additional downmix signal may correspond to a linear combination of a first group of one or more channels of the additional M-channel audio signal, and a second channel of the additional downmix signal may correspond to a linear combination of a second group of one or more channels of the additional M-channel audio signal. The first and second groups of channels of the additional M-channel audio signal may constitute a partition of the M channels of the additional M-channel audio signal. The additional decoding section may be further configured to: receive at least a portion of the additional metadata; and provide an additional two-channel output signal based on the additional downmix signal and the additional received metadata. The additional decoding section may comprise an additional decorrelating section configured to receive at least one channel of the additional downmix signal and to output, based thereon, an additional decorrelated signal. The additional decoding section may further comprise an additional mixing section configured to: determine a set of additional mixing coefficients based on the received additional metadata, and form the additional output signal as a linear combination of the additional downmix signal and the additional decorrelated signal in accordance with the additional mixing coefficients. The additional mixing section may be configured to determine the additional mixing coefficients such that a first channel of the additional output signal approximates a linear combination of a third group of one or more channels of the additional M-channel audio signal, and such that a second channel of the additional output signal approximates a linear combination of a fourth group of one or more channels of the additional M-channel audio signal. The additional mixing section may be further configured to determine the additional mixing coefficients such that the third and fourth groups of channels of the additional M-channel audio signal constitute a partition of the M channels of the additional M-channel audio signal, and such that both of the third and fourth groups of signals of the additional M-channel audio signal comprise at least one channel from the first group of channels of the additional M-channel audio signal.

In the present example embodiment, the additional decoding section, the additional decorrelating section and the additional mixing section may for example be functionally equivalent to (or analogously configured as) the decoding section, the decorrelating section and the mixing section, respectively. Alternatively, at least one of the additional decoding section, the additional decorrelating section and the additional mixing section may for example configured to perform at least one different type of computation and/or interpolation than performed by the corresponding section of the decoding section, the decorrelating section and the mixing section.

In the present example embodiment, the additional decoding section, the additional decorrelating section and the additional mixing section may for example operable independently of the decoding section, the decorrelating section and the mixing section.

In an example embodiment, the decoding system may further comprise a demultiplexer configured to extract, from a bitstream: the downmix signal, the at least a portion of the metadata, and a discretely coded audio channel. The decoding system may further comprise a single-channel decoding section operable to decode the discretely coded audio channel. The discretely coded audio channel may for example be encoded in the bitstream using a perceptual audio codec such as Dolby Digital or MPEG AAC, and the single-channel decoding section may for example comprise a core decoder for decoding the discretely coded audio channel. The single-channel decoding section may for example be operable to decode the discretely coded audio channel independently of the decoding section.

According to example embodiments, there is provided a computer program product comprising a computer-readable medium with instructions for performing any of the methods of the first aspect.

According to example embodiments of the audio decoding system, method, and computer program product of the first aspect, described above, the output signal may be a K-channel signal, where $2 \leq K < M$, instead of a two-channel signal, and the K channels of the output signal may correspond to a partition of the M-channel audio signal into K groups, instead of two channels of the output signal corresponding to a partition of the M-channel signal into two groups.

More specifically, according to example embodiments, there is provided an audio decoding method which comprises receiving a two-channel downmix signal. The downmix signal is associated with metadata comprising upmix parameters for parametric reconstruction of an M-channel audio signal based on the downmix signal, where $M \geq 4$. A first channel of the downmix signal corresponds to a linear combination of a first group of one or more channels of the M-channel audio signal, and a second channel of the downmix signal corresponds to a linear combination of a second group of one or more channels of the M-channel audio signal. The first and second groups constitute a partition of the M channels of the M-channel audio signal. The audio decoding method may further comprise: receiving at least a portion of the metadata; generating a decorrelated signal based on at least one channel of the downmix signal; determining a set of mixing coefficients based on the received metadata; and forming a K-channel output signal as a linear combination of the downmix signal and the decorrelated signal in accordance with the mixing coefficients, wherein $2 \leq K < M$. The mixing coefficients may be determined such that each of the K channels of the output signal approximates a linear combination of a group of one or more channels of the M-channel audio signal (and each of the K channels of the output signal therefore corresponds to a group of one or more channels of the M-channel audio signal), the groups corresponding to the respective channels of the output signal constitute a partition of the M channels of the M-channel audio signal into K groups of one or more channels; and at least two of the K groups comprise at least one channel from the first group.

The M-channel audio signal has been encoded as the two-channel downmix signal and the upmix parameters for parametric reconstruction of the M-channel audio signal. When encoding the M-channel audio signal on an encoder side, the coding format may be chosen e.g. for facilitating reconstruction of the M-channel audio signal from the downmix signal, for improving fidelity of the M-channel audio signal as reconstructed from the downmix signal, and/or for improving coding efficiency of the downmix signal. This choice of coding format may be performed by selecting the first and second groups and forming the channels of the downmix signals as respective linear combinations of the channels in the respective groups.

The inventors have realized that although the chosen coding format may facilitate reconstruction of the M-channel audio signal from the downmix signal, the downmix signal may not itself be suitable for playback using a particular K-speaker configuration. The K-channel output signal, corresponding to a partition of the M-channel audio signal into the K groups, may be more suitable for a particular K-channel playback setting than the downmix signal. Providing the output signal based on the downmix signal and the received metadata may therefore improve K-channel playback quality as perceived by a listener, and/or improve fidelity of the K-channel playback to a sound field represented by the M-channel audio signal.

The inventors have further realized that, instead of first reconstructing the M-channel audio signal from the downmix signal and then generating the K-channel representation of the M-channel audio signal (e.g. by additive mixing), the K-channel representation provided by the output signal may be more efficiently generated from the downmix signal and the received metadata by exploiting the fact that some channels of the M-channel audio signal are grouped together similarly in the two-channel representation provided by the downmix signal and the K-channel representation to be provided. Forming the output signal as a linear combination of the downmix signal and the decorrelated signal may for example reduce computational complexity at the decoder side and/or reduce the number of components or processing steps employed to obtain a K-channel representation of the M-channel audio signal.

By the K groups constituting a partition of the channels of the M-channel audio signal is meant that the K groups are disjoint and together include all the channels of the M-channel audio signal.

Forming the K-channel output signal may for example include applying at least some of the mixing coefficients to the channels of the downmix signal, and at least some of the mixing coefficients to the one or more channels of the decorrelated signal.

The first and second channels of the downmix signal may for example correspond to (weighted or non-weighted) sums of the channels in the first and second groups of one or more channels, respectively.

The K channels of the output signal may for example approximate (weighted or non-weighted) sums of the channels in the K groups of one or more channels, respectively.

In some example embodiments, K=2, K=3, or K=4.

In some example embodiments, M=5, or M=6.

In an example embodiment, the decorrelated signal may be a two-channel signal, and the output signal may be formed by including no more than two decorrelated signal channels into the linear combination of the downmix signal and the decorrelated signal, i.e. into the linear combination from which the output signal is obtained. The inventors have realized that there is no need to reconstruct the M-channel audio signal in order to provide the two-channel output signal, and that since the full M-channel audio signal need not be reconstructed, the number of decorrelated signal channels may be reduced.

In an example embodiment, K=3 and forming the output signal may amount to a projection from four channels to three channels, i.e. a projection from the two channels of the downmix signal and two decorrelated signal channels to the three channels of the output signal. For example, the output signal may be directly obtained as a linear combination of the downmix signal and the decorrelated signal without first reconstructing the full M channels of the M-channel audio signal.

In an example embodiment, the mixing coefficients may be determined such that a pair of channels of the output signal receive contributions of equal magnitude (e.g. equal amplitude) from a channel of the decorrelated signal. The contributions from this channel of the decorrelated signal to the respective channel of the pair may have opposite signs. In other words, the mixing coefficients may be determined such that a sum of a mixing coefficient controlling a contribution from a channel of the decorrelated signal to a (e.g. a first) channel of the output signal, and a mixing coefficient controlling a contribution from the same channel of the decorrelated signal to another (e.g. a second) channel of the output signal, has the value 0. The K-channel output signal may for example include one or more channels not receiving any contribution from this particular channel of the decorrelated signal.

In an example embodiment, the mixing coefficients may be determined such that a sum of a mixing coefficient controlling a contribution from the first channel of the downmix signal to a (e.g. a first) channel of the output signal, and a mixing coefficient controlling a contribution from the first channel of the downmix signal to another (e.g. a second) channel of the output signal, has the value 1. In particular, one of the mixing coefficients may for example be derivable from the upmix parameters (e.g., sent as an explicit value or obtainable from the upmix parameters after performing computations on a compact representation, as explained in other sections of this disclosure) and the other may be readily computed by requiring the sum of both mixing coefficients to be equal to one. The K-channel output signal may for example include one or more channels not receiving any contribution from the first channel of downmix signal.

In an example embodiment, the mixing coefficients may be determined such that a sum of a mixing coefficient controlling a contribution from the second channel of the downmix signal to a (e.g. a first) channel of the output signal, and a mixing coefficient controlling a contribution from the second channel of the downmix signal another (e.g. a second) channel of the output signal, has the value one. The K-channel output signal may for example include one or more channels not receiving any contribution from the second channel of downmix signal.

In an example embodiment, the method may comprise receiving signaling indicating (a selected) one of at least two coding formats of the M-channel audio signal. The coding formats may correspond to respective different partitions of the channels of the M-channel audio signal into respective first and second groups associated with the channels of the downmix signal. The K groups may be predefined. The mixing coefficients may be determined such that a single partition of the M-channel audio signal into the K groups of channels, approximated by the channels of the output signal, is maintained for (i.e. is common to) the at least two coding formats.

In an example embodiment, the decorrelated signal may comprise two channels. A first channel of the decorrelated signal may be obtained based on the first channel of the downmix signal, e.g. by processing no more than the first channel of the downmix signal. A second channel of the decorrelated signal may be obtained based on the second channel of the downmix signal, e.g. by processing no more than the second channel of the downmix signal.

II. Overview—Encoder Side

According to a second aspect, example embodiments propose audio encoding systems as well as audio encoding methods and associated computer program products. The proposed encoding systems, methods and computer program products, according to the second aspect, may generally share the same features and advantages. Moreover, advantages presented above for features of decoding systems, methods and computer program products, according to the first aspect, may generally be valid for the corresponding features of encoding systems, methods and computer program products according to the second aspect.

According to example embodiments, there is provided an audio encoding method comprising: receiving an M-channel audio signal, where M≥4; and computing a two-channel downmix signal based on the M-channel audio signal. A first channel of the downmix signal is formed as a linear combination of a first group of one or more channels of the M-channel audio signal, and a second channel of the downmix signal is formed as a linear combination of a second group of one or more channels of the M-channel audio signal. The first and second groups constitute a partition of the M channels of the M-channel audio signal. The encoding method further comprises: determining upmix parameters for parametric reconstruction of the M-channel audio signal from the downmix signal; and determining mixing parameters for obtaining, based on the downmix signal, a two-channel output signal, wherein a first channel of the output signal approximates a linear combination of a third group of one or more channels of the M-channel audio signal, and wherein a second channel of the output signal approximates a linear combination of a fourth group of one or more channels of the M-channel audio signal. The third and fourth groups constitute a partition of the M channels of the M-channel audio signal, and both of the third and fourth groups comprise at least one channel from the first group. The encoding method further comprises: outputting the downmix signal and metadata for joint storage or transmission, wherein the metadata comprises the upmix parameters and the mixing parameters.

The channels of the downmix signal correspond to a partition of the M channels of the M-channel audio signal into the first and second groups and may for example provide a bit-efficient two-channel representation of the M-channel audio signal and/or a two-channel representation allowing for a high-fidelity parametric reconstruction of the M-channel audio signal.

The inventors have realized that although the employed two-channel representation may facilitate reconstruction of the M-channel audio signal from the downmix signal, the downmix signal may not itself be suitable for playback using a particular two-speaker arrangement. The mixing parameters, output together with the downmix signal and the upmix parameters, allows for obtaining the two-channel output signal based on the downmix signal. The output signal, corresponding to a different partition of the M-channel audio signal into the third and fourth groups of channels, may be more suitable for a particular two-channel playback setting than the downmix signal. Providing the output signal based on the downmix signal and the mixing parameters may therefore improve the two-channel playback quality as perceived by a listener, and/or improve fidelity of the two-channel playback to a sound field represented by the M-channel audio signal.

The first channel of the downmix signal may for example be formed as a sum of the channels in the first group, or as a scaling thereof. In other words, the first channel of the downmix signal may for example be formed as a sum of the channels (i.e. a sum of the audio content from the respective channels, e.g. formed by additive mixing on a per-sample or per-transform-coefficient basis) in the first group, or as a rescaled version of such a sum (e.g. obtained by summing the channels and multiplying the sum by a rescaling factor). Similarly, the second channel of the downmix signal may for example be formed as a sum of the channels in the second group, or as a scaling thereof. The first channel of the output signal may for example approximate a sum of the channels of the third group, or a scaling thereof, and the second channel of the output signal may for example approximate a sum of the channels in the fourth group, or a scaling thereof.

For example, the M-channel audio signal may be a five-channel audio signal. The audio encoding method may for example be employed for the five regular channels of one of the currently established 5.1 audio formats, or for five channels on the left or right hand side in an 11.1 multichannel audio signal. Alternatively, it may hold that $M=4$, or $M\geq 6$.

In an example embodiment, the mixing parameters may control respective contributions from the downmix signal and from a decorrelated signal to the output signal. At least some of the mixing parameters may be determined by minimizing a contribution from the decorrelated signal among such mixing parameters that cause the channels of the output signal to be covariance-preserving approximations of the linear combinations (or sums) of the first and second groups of channels, respectively. The contribution from the decorrelated signal may for example be minimized in the sense that the signal energy or amplitude of this contribution is minimized.

The linear combination of the third group, which the first channel of the output signal is to approximate, and the linear combination of the fourth group, which the second channel of the output signal is to approximate, may for example correspond to a two-channel audio signal having a first covariance matrix. The channels of the output signal being covariance-preserving approximations of the linear combinations of the first and second groups of channels, respectively, may for example correspond to that a covariance matrix of the output signal coincides (or at least substantially coincides) with the first covariance matrix.

Among the covariance-preserving approximations, a decreased size (e.g. energy or amplitude) of the contribution from the decorrelated signal may be indicative of increased fidelity of the approximation as perceived by a listener during playback. Employing mixing parameters which decrease the contribution from the decorrelated signal may improve fidelity of the output signal as a two-channel representation of the M-channel audio signal.

In an example embodiment, the first group of channels may consist of N channels, where $N\geq 3$, and at least some of the upmix parameters may be suitable for parametric reconstruction of the first group of channels from the first channel of the downmix signal and an $(N-1)$-channel decorrelated signal determined based on the first channel of the downmix signal. In the present example embodiment, determining the upmix parameters may include: determining a set of upmix coefficients of a first type, referred to as dry upmix coefficients, in order to define a linear mapping of the first channel of the downmix signal approximating the first group of channels; and determining an intermediate matrix based on a difference between a covariance of the first group of channels as received, and a covariance of the first group of channels as approximated by the linear mapping of the first channel of the downmix signal. When multiplied by a predefined matrix, the intermediate matrix may correspond to a set of upmix coefficients of a second type, referred to as wet upmix coefficients, defining a linear mapping of the decorrelated signal as part of parametric reconstruction of the first group of channels. The set of wet upmix coefficients may include more coefficients than the number of elements in the intermediate matrix. In the present example embodiment, the upmix parameters may include a first type of upmix parameters, referred to as dry upmix parameters, from which the set of dry upmix coefficients is derivable, and a second type of upmix parameters, referred to as wet upmix parameters, uniquely defining the intermediate matrix provided that the intermediate matrix belongs to a predefined matrix class. The intermediate matrix may have more elements than the number of wet upmix parameters.

In the present example embodiment, a parametric reconstruction copy of the first group of channels at a decoder side includes, as one contribution, a dry upmix signal formed by the linear mapping of the first channel of the downmix signal, and, as a further contribution, a wet upmix signal formed by the linear mapping of the decorrelated signal. The set of dry upmix coefficients defines the linear mapping of the first channel of the downmix signal and the set of wet upmix coefficients defines the linear mapping of the decorrelated signal. By outputting wet upmix parameters which are fewer than the number of wet upmix coefficients, and from which the wet upmix coefficients are derivable based on the predefined matrix and the predefined matrix class, the amount of information sent to a decoder side to enable reconstruction of the M-channel audio signal may be reduced. By reducing the amount of data needed for parametric reconstruction, the required bandwidth for transmission of a parametric representation of the M-channel audio signal, and/or the required memory size for storing such a representation, may be reduced.

The intermediate matrix may for example be determined such that a covariance of the signal obtained by the linear mapping of the decorrelated signal supplements the covariance of the first group of channels as approximated by the linear mapping of the first channel of the downmix signal.

How to determine and employ the predefined matrix and the predefined matrix class is described in more detail on page 16, line 15 to page 20, line 2 in U.S. provisional patent application No. 61/974,544; first named inventor: Lars Villemoes; filing date: 3 Apr. 2014. See in particular equation (9) therein for examples of the predefined matrix.

In an example embodiment, determining the intermediate matrix may include determining the intermediate matrix such that a covariance of the signal obtained by the linear mapping of the decorrelated signal, defined by the set of wet upmix coefficients, approximates, or substantially coincides with, the difference between the covariance of the first group of channels as received and the covariance of the first group of channels as approximated by the linear mapping of the first channel of the downmix signal. In other words, the intermediate matrix may be determined such that a reconstruction copy of the first group of channels, obtained as a sum of a dry upmix signal formed by the linear mapping of the first channel of the downmix signal and a wet upmix signal formed by the linear mapping of the decorrelated signal completely, or at least approximately, reinstates the covariance of the first group of channels as received.

In an example embodiment, the wet upmix parameters may include no more than $N(N-1)/2$ independently assignable wet upmix parameters. In the present example embodiment, the intermediate matrix may have $(N-1)^2$ matrix elements and may be uniquely defined by the wet upmix parameters provided that the intermediate matrix belongs to the predefined matrix class. In the present example embodiment, the set of wet upmix coefficients may include $N(N-1)$ coefficients.

In an example embodiment, the set of dry upmix coefficients may include N coefficients. In the present example embodiment, the dry upmix parameters may include no more than $N-1$ dry upmix parameters, and the set of dry upmix coefficients may be derivable from the $N-1$ dry upmix parameters using a predefined rule.

In an example embodiment, the determined set of dry upmix coefficients may define a linear mapping of the first channel of the downmix signal corresponding to a minimum mean square error approximation of the first group of channels, i.e. among the set of linear mappings of the first channel of the downmix signal, the determined set of dry upmix coefficients may define the linear mapping which best approximates the first group of channels in a minimum mean square sense.

In an example embodiment, the encoding method may further comprise selecting one of at least two coding formats, wherein the coding formats correspond to respective different partitions of the channels of the M-channel audio signal into respective first and second groups associated with the channels of the downmix signal. The first and second channels of the downmix signal may be formed as linear combinations of a first and a second group of one or more channels, respectively, of the M-channel audio signal, in accordance with the selected coding format. The upmix parameters and the mixing parameters may be determined based on the selected coding format. The encoding method may further comprise providing signaling indicating the selected coding format. The signaling may for example be output for joint storage and/or transmission with the downmix signal and the metadata.

The M-channel audio signal as reconstructed based on the downmix signal and the upmix parameters may be a sum of: a dry upmix signal formed by applying dry upmix coefficients to the downmix signal; and a wet upmix signal formed by applying wet upmix coefficients to a decorrelated signal determined based on the downmix signal. The selection of a coding format may for example be made based on a difference between a covariance of the M-channel audio signal as received and a covariance of the M-channel audio signal as approximated by the dry upmix signal, for the respective coding formats. The selection of a coding format may for example be made based on the wet upmix coefficients for the respective coding formats, e.g. based on respective sums of squares of the wet upmix coefficients for the respective coding formats. The selected coding format may for example be associated with a minimal one of the sums of squares of the respective coding formats.

According to example embodiments, there is provided an audio encoding system comprising an encoding section configured to encode an M-channel audio signal as a two-channel downmix signal and associated metadata, where $M \geq 4$, and to output the downmix signal and metadata for joint storage or transmission. The encoding section comprises a downmix section configured to compute the downmix signal based on the M-channel audio signal. A first channel of the downmix signal is formed as a linear combination of a first group of one or more channels of the M-channel audio signal, and a second channel of the downmix signal is formed as a linear combination of a second group of one or more channels of the M-channel audio signal. The first and second groups constitute a partition of the M channels of the M-channel audio signal. The encoding section further comprises an analysis section configured to determine: upmix parameters for parametric reconstruction of the M-channel audio signal from the downmix signal; and mixing parameters for obtaining, based on the downmix signal, a two-channel output signal. A first channel of the output signal approximates a linear combination of a third group of one or more channels of the M-channel audio signal, and a second channel of the output signal approximates a linear combination of a fourth group of one or more channels of the M-channel audio signal. The third and fourth groups constitute a partition of the M channels of the M-channel audio signal. Both of the third and fourth groups comprise at least one channel from the first group. The metadata comprises the upmix parameters and the mixing parameters.

According to example embodiments, there is provided a computer program product comprising a computer-readable medium with instructions for performing any of the methods of the second aspect.

According to example embodiments of the audio encoding system, method, and computer program product of the second aspect, described above, the output signal may be a K-channel signal, where $2 \leq K < M$, instead of a two-channel signal, and the K channels of the output signal may correspond to a partition of the M-channel audio signal into K groups, instead of two channels of the output signal corresponding to a partition of the M-channel signal into two groups.

More specifically, according to example embodiments, there is provided an audio encoding method comprising: receiving an M-channel audio signal, where $M \geq 4$; and computing a two-channel downmix signal based on the M-channel audio signal. A first channel of the downmix signal is formed as a linear combination of a first group of one or more channels of the M-channel audio signal, and a second channel of the downmix signal is formed as a linear combination of a second group of one or more channels of the M-channel audio signal. The first and second groups constitute a partition of the M channels of the M-channel audio signal. The encoding method may further comprise: determining upmix parameters for parametric reconstruction of the M-channel audio signal from the downmix signal; and determining mixing parameters for obtaining, based on the downmix signal, a K-channel output signal, wherein $2 \leq K < M$, wherein each of the K channels of the output signal approximates a linear combination of a group of one or more channels of the M-channel audio signal. The groups corresponding to the respective channels of the output signal may constitute a partition of the M channels of the M-channel audio signal into K groups of one or more channels, and at least two of the K groups may comprise at least one channel from the first group. The encoding method may further comprise outputting the downmix signal and metadata for joint storage or transmission, wherein the metadata comprises the upmix parameters and the mixing parameters.

In an example embodiment, the mixing parameters may control respective contributions from the downmix signal and from a decorrelated signal to the output signal. At least some of the mixing parameters may be determined by minimizing a contribution from the decorrelated signal among such mixing parameters that cause the channels of the output signal to be covariance-preserving approximations of the linear combinations (or sums) of the one or more channels of the respective K groups of channels. The contribution from the decorrelated signal may for example be minimized in the sense that the signal energy or amplitude of this contribution is minimized.

The linear combinations of the channels of the K groups, which the K channels of the output signal are to approximate, may for example correspond to a K-channel audio signal having a first covariance matrix. The channels of the output signal being covariance-preserving approximations of the linear combinations of the channels of the K groups of channels, respectively, may for example correspond to that a covariance matrix of the output signal coincides (or at least substantially coincides) with the first covariance matrix.

Among the covariance-preserving approximations, a decreased size (e.g. energy or amplitude) of the contribution from the decorrelated signal may be indicative of increased fidelity of the approximation as perceived by a listener during playback. Employing mixing parameters which decrease the contribution from the decorrelated signal may improve fidelity of the output signal as a K-channel representation of the M-channel audio signal.

III. Overview—Computer-Readable Medium

According to a third aspect, example embodiments propose computer-readable media. Advantages presented above for features of systems, methods and computer program products, according to the first and/or second aspects, may generally be valid for the corresponding features of computer-readable-media according to the third aspect.

According to example embodiments, there is provided a data carrier representing: a two-channel downmix signal; and upmix parameters allowing parametric reconstruction of an M-channel audio signal based on the downmix signal, where $M \geq 4$. A first channel of the downmix signal corresponds to a linear combination of a first group of one or more channels of the M-channel audio signal, and a second channel of the downmix signal corresponds to a linear combination of a second group of one or more channels of the M-channel audio signal. The first and second groups constitute a partition of the M channels of the M-channel audio signal. The data carrier further represents mixing parameters allowing provision of a two-channel output signal based on the downmix signal. A first channel of the output signal approximates a linear combination of a third group of one or more channels of the M-channel audio signal, and a second channel of the output signal approximates a linear combination of a fourth group of one or more channels of the M-channel audio signal. The third and fourth groups constitute a partition of the M channels of the M-channel audio signal. Both of the third and fourth groups comprise at least one channel from the first group.

In an example embodiment, data represented by the data carrier may be arranged in time frames and may be layered such that, for a given time frame, the downmix signal and associated mixing parameters for that time frame may be extracted independently of the associated upmix parameters. For example, the data carrier may be layered such that the downmix signal and associated mixing parameters for that time frame may be extracted without extracting and/or accessing the associated upmix parameters. According to example embodiments of the computer-readable medium (or data carrier) of the third aspect, described above, the output signal may be a K-channel signal, where $2 \leq K < M$, instead of a two-channel signal, and the K channels of the output signal may correspond to a partition of the M-channel audio signal into K groups, instead of two channels of the output signal corresponding to a partition of the M-channel signal into two groups.

More specifically, according to example embodiments, there is provided a computer-readable medium (or data carrier) representing: a two-channel downmix signal; and upmix parameters allowing parametric reconstruction of an M-channel audio signal based on the downmix signal, where $M \geq 4$. A first channel of the downmix signal corresponds to a linear combination of a first group of one or more channels of the M-channel audio signal, and a second channel of the downmix signal corresponds to a linear combination of a second group of one or more channels of the M-channel audio signal. The first and second groups constitute a partition of the M channels of the M-channel audio signal. The data carrier may further represent mixing parameters allowing provision of a K-channel output signal based on the downmix signal, where $2 \leq K < M$. Each channel of the output signal may approximate a linear combination (e.g. weighted or non-weighted sum) of a group of one or more channels of the M-channel audio signal. The groups corresponding to the respective channels of the output signal may constitute a partition of the M channels of the M-channel audio signal into K groups of one or more channels. At least two of the K groups may comprise at least one channel from the first group.

Further example embodiments are defined in the dependent claims. It is noted that example embodiments include all combinations of features, even if recited in mutually different claims.

IV. Example Embodiments

Figure 4:
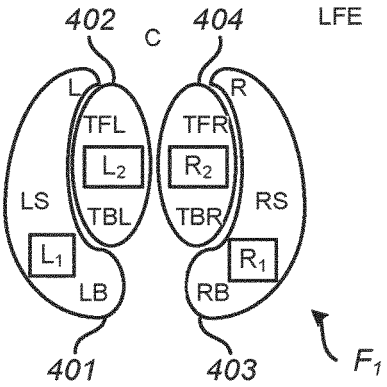
FIGS. 4-6 illustrate alternative ways to partition an 11.1-channel (or 7.1+4-channel or 7.1.4-channel) audio signal into groups of channels represented by respective downmix channels, according to example embodiments.
Figure 5:
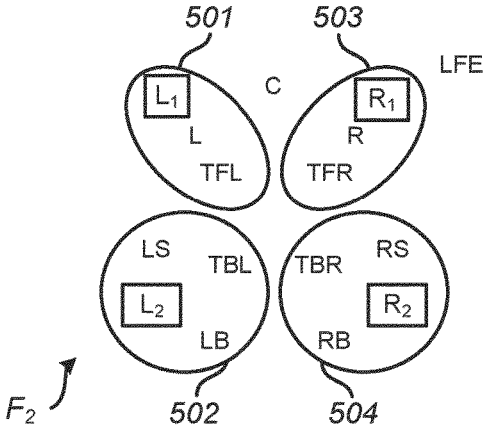
Figure 6:
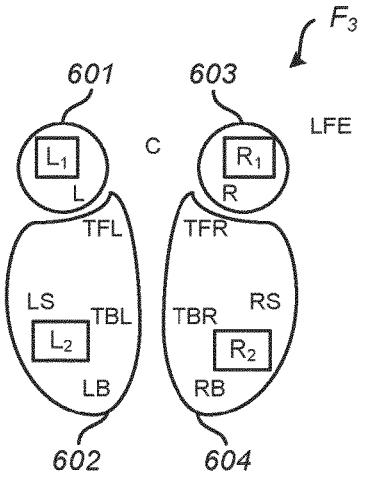

FIGS. 4-6 illustrate alternative ways to partition an 11.1-channel audio signal into groups of channels for parametric encoding of the 11.1-channel audio signal as a 5.1-channel audio signal, or for playback of the 11.1-channel audio signal at speaker system comprising five loudspeakers and one subwoofer.

The 11.1-channel audio signal comprises the channels L (left), LS (left side), LB (left back), TFL (top front left), TBL (top back left), R (right), RS (right side), RB (right back), TFR (top front right), TBR (top back right), C (center), and LFE (low frequency effects). The five channels L, LS, LB, TFL and TBL form a five-channel audio signal representing a left half-space in a playback environment of the 11.1-channel audio signal. The three channels L, LS and LB represent different horizontal directions in the playback environment and the two channels TFL and TBL represent directions vertically separated from those of the three channels L, LS and LB. The two channels TFL and TBL may for example be intended for playback in ceiling speakers. Similarly, the five channels R, RS, RB, TFR and TBR form an additional five-channel audio signal representing a right half-space of the playback environment, the three channels R, RS and RB representing different horizontal directions in the playback environment and the two channels TFR and TBR representing directions vertically separated from those of the three channels R, RS and RB.

In order to represent the 11.1-channel audio signal as a 5.1-channel audio signal, the collection of channels L, LS, LB, TFL, TBL, R, RS, RB, TFR, TBR, C, and LFE may be partitioned into groups of channels represented by respective downmix channels and associated metadata. The five-channel audio signal L, LS, LB, TFL, TBL may be represented by a two-channel downmix signal $L_1$, $L_2$ and associated metadata, while the additional five-channel audio signal R, RS, RB, TFR, TBR may be represented by an additional two-channel downmix signal $R_1$, $R_2$ and associated additional metadata. The channels C and LFE may be kept as separate channels also in the 5.1-channel representation of the 11.1-channel audio signal.

FIG. 4 illustrates a first coding format $F_1$, in which the five-channel audio signal L, LS, LB, TFL, TBL is partitioned into a first group 401 of channels L, LS, LB and a second group 402 of channels TFL, TBL, and in which the additional five-channel audio signal R, RS, RB, TFR, TBR is partitioned into an additional first group 403 of channels R, RS, RB and an additional second group 404 of channels TFR, TBR. In the first coding format $F_1$, the first group of channels 401 is represented by a first channel $L_1$ of the two-channel downmix signal, and the second group 402 of channels is represented by a second channel $L_2$ of the two-channel downmix signal. The first channel $L_1$ of the downmix signal may correspond to a sum of the first group 401 of channels as per $$L_1=L+LS+LB,$$

and the second channel $L_2$ of the downmix signal may correspond to a sum of the second group 402 of channels as per $$L_2=TFL+TBL.$$

In some example embodiments, some or all of the channels may be rescaled prior to summing, so that the first channel $L_1$ of the downmix signal may correspond to a linear combination of the first group 401 of channels according to $L_1=c_1L+c_2LS+c_3LB$, and the second channel $L_2$ of the downmix signal may correspond to a linear combination of the second group 402 of channels according to $L_2=c_4TFL+c_5TBL$. The gains $c_2$, $c_3$, $c_4$, $c_5$ may for example coincide, while the gain $c_1$ may for example have a different value; e.g., $c_1$ may correspond to no rescaling at all. For example, values $c_1=1$ and $c_2=c_3=c_4=c_5=1/\sqrt{2}$ may be used. However, as long as the gains $c_1, \ldots, c_5$ applied to the respective channels L, LS, LB, TFL, TBL for the first coding format $F_1$ coincide with gains applied to these channels in the other coding formats $F_2$ and $F_3$, described below with reference to FIGS. 5 and 6, these gains do not affect the computations described below. Hence, the equations and approximation derived below for the channels L, LS, LB, TFL, TBL apply also for rescaled versions $c_1L$, $c_2LS$, $c_3LB$, $c_4TFL$, $c_5TBL$ of these channels. If, on the other hand, different gains are employed in the different coding formats, at least some of the computations performed below may have to be modified; for instance, the option of including additional decorrelators may be considered, in the interest of providing more faithful approximations.

Similarly, the additional first group of channels 403 is represented by a first channel $R_1$ of the additional downmix signal, and the additional second group 404 of channels is represented by a second channel $R_2$ of the additional downmix signal.

The first coding format $F_1$ provides dedicated downmix channels $L_2$ and $R_2$ for representing the ceiling channels TFL, TBL, TFR and TBR. Use of the first coding format $F_1$ may therefore allow parametric reconstruction of the 11.1-channel audio signal with relatively high fidelity in cases where, e.g., a vertical dimension in the playback environment is important for the overall impression of the 11.1-channel audio signal.

FIG. 5 illustrates a second coding format $F_2$, in which the five-channel audio signal L, LS, LB, TFL, TBL is partitioned into third 501 and fourth 502 groups of channels represented by respective channels $L_1$ and $L_2$, where the channels $L_1$ and $L_2$ correspond to sums of the respective groups of channels, e.g. employing the same gains $c_1, \ldots, c_5$ for rescaling as in the first coding format $F_1$. Similarly, the additional five-channel audio signal R, RS, RB, TFR, TBR is partitioned into additional third 503 and fourth 504 groups of channels represented by respective channels $R_1$ and $R_2$.

The second coding format $F_2$ does not provide dedicated downmix channels for representing the ceiling channels TFL, TBL, TFR and TBR but may allow parametric reconstruction of the 11.1-channel audio signal with relatively high fidelity e.g. in cases where the vertical dimension in the playback environment is not as important for the overall impression of the 11.1 channel audio signal. The second coding format $F_2$ may also be more suitable for 5.1 channel playback than the first coding format $F_1$.

FIG. 6 illustrates a third coding format $F_3$, in which the five-channel audio signal L, LS, LB, TFL, TBL is partitioned into fifth 601 and sixth 602 groups of channels represented by respective channels $L_1$ and $L_2$ of the downmix signal, where the channels $L_1$ and $L_2$ correspond to sums of the respective groups of channels, e.g. employing the same gains $c_1, \ldots, c_5$ for rescaling as in the first coding format $F_1$. Similarly, the additional five-channel signal R, RS, RB, TFR, TBR is partitioned into additional fifth 603 and sixth 604 groups of channels represented by respective channels $R_1$ and $R_2$.

In the third coding format $F_3$, the four channels LS, LB, TFL and TBL are represented by the second channel $L_2$. Although high-fidelity parametric reconstruction of the 11.1-channel audio signal may potentially be more difficult in the third coding format $F_3$ than in the other coding formats, the third coding format $F_3$ may for example be employed for 5.1-channel playback.

The inventors have realized that metadata associated with a 5.1-channel representation of the 11.1-channel audio signal according to one of the coding formats $F_1$, $F_2$ $F_3$ may be employed to generate a 5.1-channel representation according to another of the coding formats $F_1$, $F_2$, $F_3$ without first reconstructing the original 11.1-channel signal. The five-channel signal L, LS, LB, TFL, TBL representing the left half-plane of the 11.1-channel audio signal, and the additional five-channel signal R, RS, RB, TFR, TBR representing the right half-plane, may be treated analogously.

Assume that three channels $x_1$, $x_2$, $x_3$ have been summed to form a downmix channel $m_1$, according to $m_1=x_1+x_2+x_3$, and that $x_1$ and $x_2+x_3$ are to be reconstructed. All three channels $x_1$, $x_2$, $x_3$ are reconstructable from the downmix channel $m_1$ as $$\begin{bmatrix} x_1 \\ x_2 \\ x_3 \end{bmatrix} \approx \begin{bmatrix} c_1 \\ c_2 \\ c_3 \end{bmatrix} m_1 + \begin{bmatrix} p_{11} & p_{12} \\ p_{21} & p_{22} \\ p_{31} & p_{32} \end{bmatrix} \begin{bmatrix} D_1(m_1) \\ D_2(m_1) \end{bmatrix}$$

by employing upmix parameters $c_i$, $1 \le i \le 3$, and $p_{ij}$, $1 \le i \le 3$, $1 \le j \le 2$ determined on an encoder side, and independent decorrelators $D_1$ and $D_2$. Assuming that the employed upmix parameters satisfy $c_1+c_2+c_3=1$ and $p_{ik}=p_{2k}+p_{3k}=0$, for k=1, 2, then the signals $x_1$ and $x_2+x_3$ may be reconstructed as $$\begin{bmatrix} x_1 \\ x_2+x_3 \end{bmatrix} \approx \begin{bmatrix} c_1 \\ 1-c_1 \end{bmatrix} m_1 + \begin{bmatrix} p_{11} & p_{12} \\ -p_{11} & -p_{12} \end{bmatrix} \begin{bmatrix} D_1(m_1) \\ D_2(m_1) \end{bmatrix},$$

which may be expressed as $$\begin{bmatrix} x_1 \\ x_2+x_3 \end{bmatrix} \approx \begin{bmatrix} c_1 \\ 1-c_1 \end{bmatrix} m_1 + \begin{bmatrix} p_1 \\ -p_1 \end{bmatrix} D_1(m_1), \tag{1}$$

where the two decorrelators $D_1$ and $D_2$ have been replaced by a single decorrelator $D_1$, and where $p_1^2=p_{11}^2+p_{12}^2$. If two channels $x_4$ and $x_5$ have been summed to form a second downmix channel $m_2$ according to $m_2=x_4+x_5$, then the signals $x_1$ and $x_2+x_3+x_4+x_5$ may be reconstructed as $$\begin{bmatrix} x_1 \\ x_2+x_3+x_4+x_5 \end{bmatrix} \approx \begin{bmatrix} c_1 & 0 \\ 1-c_1 & 1 \end{bmatrix} \begin{bmatrix} m_1 \\ m_2 \end{bmatrix} + \begin{bmatrix} p_1 \\ -p_1 \end{bmatrix} D_1(m_1). \tag{2}$$

As described below, equation (2) may be employed for generating signals conformal to the third coding format $F_3$ based on signals conformal to the first coding format $F_1$.

The channels $x_4$ and $x_5$ are reconstructable as $$\begin{bmatrix} x_4 \\ x_5 \end{bmatrix} \approx \begin{bmatrix} d_1 \\ d_2 \end{bmatrix} m_2 + \begin{bmatrix} q_1 \\ q_2 \end{bmatrix} D_3(m_2) = \begin{bmatrix} d_1 \\ 1-d_1 \end{bmatrix} m_2 + \begin{bmatrix} q_1 \\ -q_1 \end{bmatrix} D_3(m_2) \tag{3}$$

employing a decorrelator $D_3$ and upmix parameters satisfying $d_1+d_2=1$ and $q_1+q_2=0$. Based on equations (1) and (3), the signals $x_1+x_4$ and $x_2+x_3+x_5$ may be reconstructed as $$\begin{bmatrix} x_1+x_4 \\ x_2+x_3+x_5 \end{bmatrix} \approx \begin{bmatrix} c_1 & d_1 \\ 1-c_1 & 1-d_1 \end{bmatrix} \begin{bmatrix} m_1 \\ m_2 \end{bmatrix} + \begin{bmatrix} 1 \\ -1 \end{bmatrix} (p_1 D_1(m_1) + q_1 D_3(m_2)),$$

and as $$\begin{bmatrix} x_1+x_4 \\ x_2+x_3+x_5 \end{bmatrix} \approx \begin{bmatrix} c_1 & d_1 \\ 1-c_1 & 1-d_1 \end{bmatrix} \begin{bmatrix} m_1 \\ m_2 \end{bmatrix} + \begin{bmatrix} 1 \\ -1 \end{bmatrix} D_1(am_1 + bm_2), \tag{4}$$

where the contributions from the two decorrelators $D_1$ and $D_3$ (i.e. decorrelators of a type preserving the energy of its input signal) have been approximated by a contribution from a single decorrelator $D_1$ (i.e. a decorrelator of a type preserving the energy of its input signal). This approximation may be associated with very small perceived loss of fidelity, particularly if the downmix channels $m_1$, $m_2$ are uncorrelated and if the values $a=p_1$ and $b=q_1$ are employed for the weights a and b. The coding format according to which the downmix channels $m_1$, $m_2$ are generated on an encoder side may for example have been chosen in an effort to keep the correlation between the downmix channels $m_1$,$m_2$ low. As described below, equation (4) may be employed for generating signals conformal to the second coding format $F_2$ based on signals conformal to the first coding format $F_1$.

The structure of equation (4) may optionally be modified into $$\begin{bmatrix} x_1+x_4 \\ x_2+x_3+x_5 \end{bmatrix} \approx \begin{bmatrix} c_1 & d_1 \\ 1-c_1 & 1-d_1 \end{bmatrix} \begin{bmatrix} m_1 \\ m_2 \end{bmatrix} + \begin{bmatrix} g \\ -g \end{bmatrix} D_1\left(\frac{a}{g} m_1 + \frac{b}{g} m_2\right),$$

where a gain factor $g=(a^2+b^2)^{1/2}$ is employed to adjust the power of the input signal to the decorrelator $D_1$. Other values of the gain factor may also be employed, such as $g=(a^2+b^2)^{1/v}$, for $0<v<1$.

If the first coding format $F_1$ is employed for providing a parametric representation of the 11.1-channel signal, and the second coding format $F_2$ is desired at a decoder side for rendering of the audio content, then applying the approximation of equation (4) on both the left and right sides, and indicating the approximate nature of some of the left-side quantities (four channels of the output signal) by tildes, yields $$\begin{bmatrix} \tilde{L}_1 \\ \tilde{R}_1 \\ C \\ \tilde{L}_2 \\ \tilde{R}_2 \end{bmatrix} = \begin{bmatrix} c_{1,L} & 0 & 0 & d_{1,L} & 0 & 1 & 0 \\ 0 & c_{1,R} & 0 & 0 & d_{1,R} & 0 & 1 \\ 0 & 0 & 1 & 0 & 0 & 0 & 0 \\ 1-c_{1,L} & 0 & 0 & 1-d_{1,L} & 0 & -1 & 0 \\ 0 & 1-c_{1,R} & 0 & 0 & 1-d_R & 0 & -1 \end{bmatrix} \begin{bmatrix} L_1 \\ R_1 \\ C \\ L_2 \\ R_2 \\ S_L \\ S_R \end{bmatrix}, \tag{5}$$

where, according to the second coding format $F_2$, $$\widetilde{L_1} \approx L+TFL \text{ and } \widetilde{L_2} \approx LS+LB+TBL,$$

$$\widetilde{R_1} \approx R+TFR \text{ and } \widetilde{R_2} \approx RS+RB+TBR,$$

where $S_L=D(a_L L_1+b_L L_2)$ and $S_R=D(a_R R_1+b_R R_2)$, where $c_{1,L}$, $d_{1,L}$, $a_L$, $b_L$ and $c_{1,R}$, $d_{1,R}$, $a_R$, $b_R$ are left-channel and right-channel versions, respectively, of the parameters $c_1$, $d_1$, a, b from equation (4), and where D denotes a decorrelation operator. Hence, an approximation of the second coding format $F_2$ may be obtained from the first coding format $F_1$ based on upmix parameters for parametric reconstruction of the 11.1-channel audio signal, without actually having to reconstruct the 11.1-channel audio signal.

If the first coding format $F_1$ is employed for providing a parametric representation of the 11.1-channel signal, and the third coding format $F_3$ is desired at a decoder side for rendering of the audio content, then applying the approximation of equation (2) on both the left and right sides, and indicating the approximate nature of some of the left-side quantities, yields:

$$\begin{bmatrix} \tilde{L}_1 \\ \tilde{R}_1 \\ C \\ \tilde{L}_2 \\ \tilde{R}_2 \end{bmatrix} = \begin{bmatrix} c_{1,L} & 0 & 0 & 0 & 0 & p_{1,L} & 0 \\ 0 & c_{1,R} & 0 & 0 & 0 & 0 & p_{1,R} \\ 0 & 0 & 1 & 0 & 0 & 0 & 0 \\ 1-c_{1,L} & 0 & 0 & 1 & 0 & -p_{1,L} & 0 \\ 0 & 1-c_{1,R} & 0 & 0 & 1 & 0 & -p_{1,R} \end{bmatrix} \begin{bmatrix} L_1 \\ R_1 \\ C \\ L_2 \\ R_2 \\ D(L_1) \\ D(R_1) \end{bmatrix}, \quad (6)$$

where, by the third coding format $F_3$, $\widetilde{L_1} \approx L$ and $\widetilde{L_2} \approx LS+LB+TFL+TBL$, $\widetilde{R_1} \approx R$ and $\widetilde{R_2} \approx RS+RB+TFR+TBR$, where $c_{1,L}$, $p_{1,L}$ and $c_{1,R}$, $p_{1,R}$ are left-channel and right-channel versions, respectively, of the parameters $c_1$ and $p_1$ from equation (2), and where D denotes a decorrelation operator. Hence, an approximation of the third coding format $F_3$ may be obtained from the first coding format $F_1$ based on upmix parameters for parametric reconstruction of the 11.1-channel audio signal, without actually having to reconstruct the 11.1-channel audio signal.

If the second coding format $F_2$ is employed for providing a parametric representation of the 11.1-channel audio signal, and the first coding format $F_1$ or the third coding format $F_3$ is desired at a decoder side for rendering of the audio content, similar relations as those presented in equations (5) and (6) may be derived using the same ideas.

If the third coding format $F_3$ is employed for providing a parametric representation of the 11.1-channel audio signal, and the first coding format $F_1$ or the second coding format $F_2$ is desired at a decoder side for rendering of the audio content, at least some of the ideas described above may be employed. However, as the sixth group 602 of channels, represented by the channel $\widetilde{L_2}$, includes four channels LS,LB,TFL,TBL, more than one decorrelated channel may for example be employed for the left hand side (and similarly for the right hand side), and the other channel $\widetilde{L_1}$ representing only the channel L may for example not be included as input to any of the decorrelators.

As described above, upmix parameters for parametric reconstruction of the 11.1-channel audio signal from a 5.1-channel parametric representation (conformal to one of the coding formats $F_1$, $F_2$ and $F_3$) may be employed to obtain an alternative 5.1-channel representation of the 11.1-channel audio signal (conformal to any one of the other coding mats $F_1$, $F_2$ and $F_3$). In other example embodiments, the alternative 5.1-channel representation may be obtained based on mixing parameters specifically determined for this purpose on an encoder side. One way to determine such mixing parameters will now be described.

Given two audio signals $y_1=u_1+u_2$ and $y_2=u_3+u_4$ formed from four audio signals $u_1$, $u_2$, $u_3$, $u_4$, an approximation of the two audio signals $z_1=u_1+u_3$ and $z_2=u_2+u_4$ may be obtained. The difference $z_1-z_2$ may be estimated from $y_1$ and $y_2$ as a least squares estimate according to $$z_1-z_2=\alpha y_1+\beta y_2+r;$$

where the error signal r is orthogonal to both $y_1$ and $y_2$. Employing that $z_1+z_2=y_1+y_2$, it may then be derived that $$\begin{bmatrix} z_1 \\ z_2 \end{bmatrix} = \frac{1}{2}\left(\begin{bmatrix} 1+\alpha \\ 1-\alpha \end{bmatrix} y_1 + \begin{bmatrix} 1+\beta \\ 1-\beta \end{bmatrix} y_2 + \begin{bmatrix} 1 \\ -1 \end{bmatrix} r\right). \quad (7)$$

In order to arrive at an approximation reinstating the correct covariance structure of the signals $z_1$ and $z_2$, the error signal r may be replaced by a decorrelated signal of the same power, e.g. of the form $\gamma D(y_1+y_2)$, where D denotes decorrelation and where the parameter $\gamma$ is adjusted to preserve signal power. Employing a different parameterization of equation (7), the approximation may be expressed as $$\begin{bmatrix} z_1 \\ z_2 \end{bmatrix} \approx \begin{bmatrix} c \\ 1-c \end{bmatrix} y_1 + \begin{bmatrix} d \\ 1-d \end{bmatrix} y_2 + \begin{bmatrix} 1 \\ -1 \end{bmatrix} \gamma D(y_1+y_2). \quad (8)$$

If the first coding format $F_1$ is employed for providing a parametric representation of the 11.1-channel signal, and the second coding format $F_2$ is desired at a decoder side for rendering of the audio content, then applying the approximation of equation (8) with $z_1$=L+TFL, $z_2$=LS+LB+TBL, $y_1$=L+LS+LB, and $y_2$=TFL+TBL on the left hand side, and with $z_1$=R+TFR, $z_2$=RS+RB+TBR, $y_1$=R+RS+RB, and $y_2$=TFR+TBR on the right hand side, and indicating the approximate nature of some of the left-side quantities by tildes, yields:

$$\begin{bmatrix} \tilde{L}_1 \\ \tilde{R}_1 \\ C \\ \tilde{L}_2 \\ \tilde{R}_2 \end{bmatrix} = \begin{bmatrix} c_L & 0 & 0 & d_L & 0 & \gamma_L & 0 \\ 0 & c_R & 0 & 0 & d_R & 0 & \gamma_R \\ 0 & 0 & 1 & 0 & 0 & 0 & 0 \\ 1-c_L & 0 & 0 & 1-d_L & 0 & -\gamma_L & 0 \\ 0 & 1-c_R & 0 & 0 & 1-d_R & 0 & -\gamma_R \end{bmatrix} \begin{bmatrix} L_1 \\ R_1 \\ C \\ L_2 \\ R_2 \\ r_L \\ r_R \end{bmatrix} \quad (9)$$

where, by the first coding format $F_1$, $\widetilde{L_1} \approx L+TFL$ and $\widetilde{L_2} \approx LS+LB+TBL$, $\widetilde{R_1} \approx R+TFR$, and $\widetilde{R_2} \approx RS+RB+TBR$, where $r_L=D(L_1+L_2)$ and $r_R=D(R_1+R_2)$, where $c_L$, $d_L$, $I_L$, and $c_R$, $d_R$, $\gamma_R$ are left-channel and right-channel versions, respectively, of the parameters c, d, $\gamma$ from equation (8), and where D denotes decorrelation. Hence, an approximation of the second coding format $F_2$ may be obtained from the first coding format $F_1$ based on the mixing parameters $c_L$, $d_L$, $\gamma_L$, $c_R$, $d_R$, and $\gamma_R$, e.g. determined on an encoder side for that purpose and transmitted together with the downmix signals to a decoder side. The use of mixing parameters allows for increased control from the encoder side. Since the original 11.1-channel audio signal is available at the encoder side, the mixing parameters may for example be tuned at the encoder side so as to increase fidelity of the approximation of the second coding format $F_2$.

Similarly, an approximation of the third coding format $F_3$ may be obtained from the first coding format $F_1$ based on similar mixing parameters. Similar approximations of the first coding format $F_1$ and the third coding format $F_3$ may also be obtained from the second coding format $F_2$.

As can be seen in equation (9), the two channels of the output signal $\widetilde{L_1}$, $\widetilde{L_2}$ receive contributions of equal magnitude from the decorrelated signal $r_L$, but of opposite signs. The corresponding situation holds for the contributions from the decorrelated signals $S_L$ and $D(L_1)$ in equations (5) and (6), respectively.

As can be seen in equation (9), the sum of the mixing coefficient $c_L$ controlling a contribution from the first channel $L_1$ of the downmix signal to the first channel $\widetilde{L_1}$ of the output signal, and the mixing coefficient $1-c_L$ controlling a contribution from the first channel $L_1$ of the downmix signal to the second channel $\widetilde{L_2}$ of the output signal, has the value 1. Corresponding relations hold in equations (5) and (6) as well.

FIG. 1 is a generalized block diagram of an encoding section 100 for encoding a M-channel signal as a two-channel downmix signal and associated metadata, according to an example embodiment.

The M-channel audio signal is exemplified herein by the five-channel signal L, LS, LB, TFL and TBL described with reference to FIG. 4, and the downmix signal is exemplified by the first channel $L_1$ and a second channel $L_2$ computed according to the first coding format $F_1$ described with reference to FIG. 4. Example embodiments may be envisaged in which the encoding section 100 computes a downmix signal according to any of the coding formats described with reference to FIGS. 4 to 6. Example embodiments may also be envisaged in which the encoding section 100 computes a downmix signal based on an M-channel audio signal, where M≥4. In particular, it will be appreciated that computations and approximations similar to those described above, and leading up to equations (5), (6) and (9), may be performed for example embodiments where M=4, or M≥6.

The encoding section 100 comprises a downmix section 110 and an analysis section 120. The downmix section 110 computes the downmix signal based on the five-channel audio signal by forming the first channel $L_1$ of the downmix signal as a linear combination (e.g. as a sum) of the first group 401 of channels of the five-channel audio signal, and by forming the second channel $L_2$ of the downmix signal as a linear combination (e.g. as a sum) of the second group 402 of channels of the five-channel audio signal. The first and second groups 401, 402 constitute a partition of the five channels L, LS, LB, TFL, TBL of the five-channel audio signal. The analysis section 120 determines upmix parameters $\alpha_{LU}$ for parametric reconstruction of the five-channel audio signal from the downmix signal in a parametric decoder. The analysis section 120 also determines mixing parameters $\alpha_{LM}$ for obtaining, based on the downmix signal, a two-channel output signal.

In the present example embodiment, the output signal is a two-channel representation of the five-channel audio signal in accordance with the second coding format $F_2$ described with reference to FIG. 5. However, example embodiments may also be envisaged in which the output signal represents the five-channel audio signal according to any of the coding formats described with reference to FIGS. 4 to 6.

A first channel $\widetilde{L_1}$ of the output signal approximates a linear combination (e.g. a sum) of the third group 501 of channels of the five-channel audio signal, and a second channel $\widetilde{L_2}$ of the output signal approximates a linear combination (e.g. a sum) of the fourth group 502 of channels of the five-channel audio signal. The third and fourth groups 501, 502 constitute a different partition of the five channels L, LS, LB, TFL, TBL of the five-channel audio signal than provided by the first and second groups 401, 402 of channels. In particular, the third group 501 comprises the channel L from the first group 401, while the fourth group 502 comprises the channels LS and LB from first group 401.

The encoding section 100 outputs the downmix signal $L_1$, $L_2$ and associated metadata for joint storage and/or transmission to a decoder side. The metadata comprises the upmix parameters $\alpha_{LU}$ and the mixing parameters $\alpha_{LM}$. The mixing parameters $\alpha_{LM}$ may carry sufficient information for employing equation (9) to obtain the output signal $\widetilde{L_1}$, $\widetilde{L_2}$ based on the downmix signal $L_1$, $L_2$. The mixing parameters $\alpha_{LM}$ may for example include the parameters $c_L$, $d_L$, $\gamma_L$ or even all the elements of the leftmost matrix in equation (9).

Figure 2:
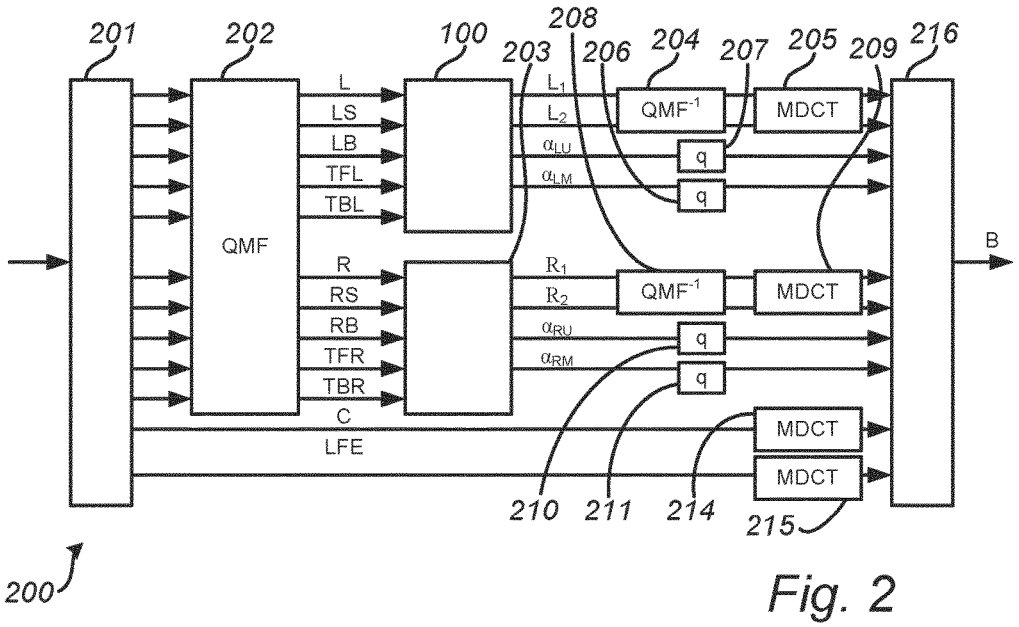
FIG. 2 is a generalized block diagram of an audio encoding system comprising the encoding section depicted in FIG. 1, according to an example embodiment.

FIG. 2 is a generalized block diagram of an audio encoding system 200 comprising the encoding section 100 described with reference to FIG. 1, according to an example embodiment. In the present example embodiment, audio content, e.g. recorded by one or more acoustic transducers 201, or generated by audio authoring equipment 201, is provided in the form of the 11.1 channel audio signal described with reference to FIGS. 4 to 6. A quadrature mirror filter (QMF) analysis section 202 transforms the five-channel audio signal L, LS, LB TFL, TBL, time segment by time segment, into a QMF domain for processing by the encoding section 100 of the five-channel audio in the form of time/frequency tiles. The audio encoding system 200 comprises an additional encoding section 203 analogous to the encoding section 100 and adapted to encode the additional five-channel audio signal R, RS, RB, TFR and TBR as the additional two-channel downmix signal $R_1$, $R_2$ and associated metadata comprising additional upmix parameters $\alpha_{RU}$ and additional mixing parameters $\alpha_{RM}$. The additional mixing parameters $\alpha_{RM}$ may for example include the parameters $c_R$, $d_R$, and $\gamma_R$ from equation (9). The QMF analysis section 202 also transforms the additional five-channel audio signal R, RS, RB, TFR and TBR into a QMF domain for processing by the additional encoding section 203. The downmix signal $L_1$ $L_2$ output by the encoding section 100 is transformed back from the QMF domain by a QMF synthesis section 204 and is transformed into a modified discrete cosine transform (MDCT) domain by a transform section 205. Quantization sections 206 and 207 quantize the upmix parameters $\alpha_{LU}$ and the mixing parameters $\alpha_{LM}$, respectively. For example, uniform quantization with a step size of 0.1 or 0.2 (dimensionless) may be employed, followed by entropy coding in the form of Huffman coding. A coarser quantization with step size 0.2 may for example be employed to save transmission bandwidth, and a finer quantization with step size 0.1 may for example be employed to improve fidelity of the reconstruction on a decoder side. Similarly, the additional downmix signal $R_1$, $R_2$ output by the additional encoding section 203 is transformed back from the QMF domain by a QMF synthesis section 208 and is transformed into a MDCT domain by a transform section 209. Quantization sections 210 and 211 quantize the additional upmix parameters $\alpha_{RU}$ and the additional mixing parameters $\alpha_{RM}$, respectively. The channels C and LFE are also transformed into a MDCT domain by respective transform sections 214 and 215. The MDCT-transformed downmix signals and channels, and the quantized metadata, are then combined into a bitstream B by a multiplexer 216, for transmission to a decoder side. The audio encoding system 200 may also comprise a core encoder (not shown in FIG. 2) configured to encode the downmix signal $L_1$, $L_2$, the additional downmix signal $R_1$, $R_2$ and the channels C and LFE using a perceptual audio codec, such as Dolby Digital or MPEG AAC, before the downmix signals and the channels C and LFE are provided to the multiplexer 216. A clip gain, e.g. corresponding to −8.7 dB, may for example be applied to the downmix signal $L_1$, $L_2$, the additional downmix signal $R_1$ $R_2$, and the channel C, prior to forming the bitstream B.

Figure 3:
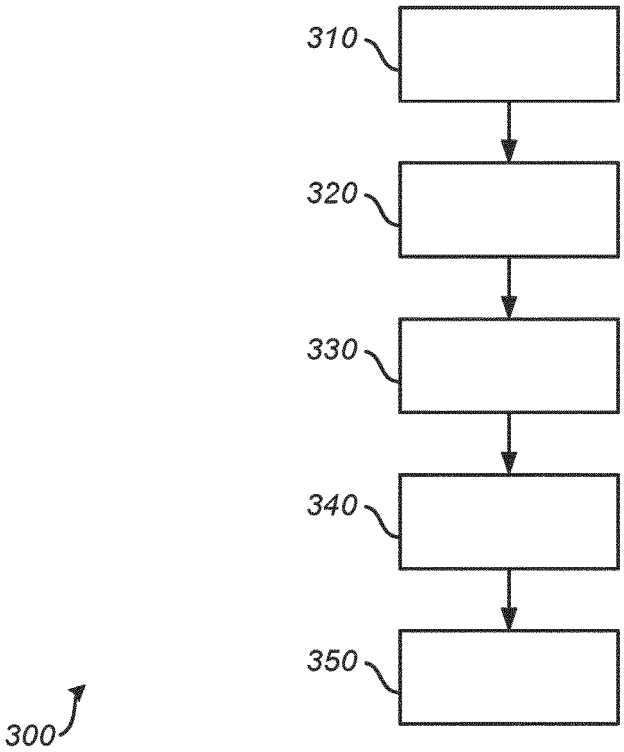
FIG. 3 is a flow chart of an audio encoding method for encoding an M-channel audio signal as a two-channel downmix signal and associated metadata, according to an example embodiment.

FIG. 3 is a flow chart of an audio encoding method 300 performed by the audio encoding system 200, according to an example embodiment. The audio encoding method 300 comprises: receiving 310 the five-channel audio signal L, LS, LB, TFL, TBL; computing 320 the two-channel downmix signal $L_1$, $L_2$ based on the five-channel audio signal; determining 330 the upmix parameters $\alpha_{LU}$; determining 340 the mixing parameters $\alpha_{LM}$; and outputting 350 the downmix signal and metadata for joint storage and/or transmission, wherein the metadata comprises the upmix parameters $\alpha_{LU}$ and the mixing parameters $\alpha_{LM}$.

Figure 7:
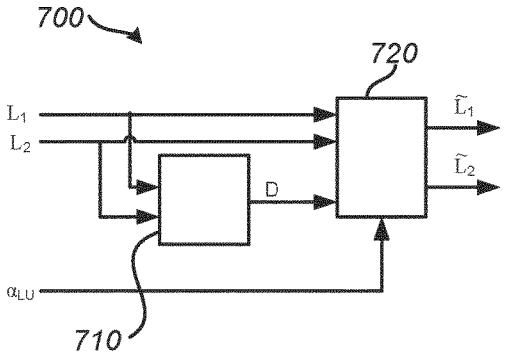
FIG. 7 is a generalized block diagram of a decoding section for providing a two-channel output signal based on a two-channel downmix signal and associated upmix parameters, according to an example embodiment.

FIG. 7 is a generalized block diagram of a decoding section 700 for providing a two-channel output signal $L_1$, $L_2$ based on a two-channel downmix signal $L_1$, $L_2$ and associated metadata, according to an example embodiment.

In the present example embodiment, the downmix signal $L_1$, $L_2$ is the downmix signal $L_1$, $L_2$ output by the encoding section 100 described with reference to FIG. 1, and is associated with both the upmix parameters $\alpha_{LU}$ and the mixing parameters $\alpha_{LM}$ output by the encoding section 100. As described with reference to FIGS. 1 and 4, the upmix parameters $\alpha_{LU}$ are adapted for parametric reconstruction of the five-channel audio signal L, LS, LB, TFL, TBL based on the downmix signal $L_1$, $L_2$. However, embodiments may also be envisaged in which the upmix parameters $\alpha_{LU}$ are adapted for parametric reconstruction of an M-channel audio signal, where M=4, or M≥6.

In the present example embodiment, the first channel $L_1$ of the downmix signal corresponds to a linear combination (e.g. a sum) of the first group 401 of channels of the five-channel audio signal, and the second channel $L_2$ of the downmix signal corresponds to a linear combination (e.g. a sum) of the second group 402 of channels of the five-channel audio signal. The first and second groups 401, 402 constitute a partition of the five channels L, LS, LB, TFL, TBL of the five-channel audio signal.

In the present example embodiment, the decoding section 700 receives the two-channel downmix signal $L_1$, $L_2$ and the upmix parameters $\alpha_{LU}$, and provides the two-channel output signal $\widetilde{L_1}$, $\widetilde{L_2}$ based on the downmix signal $L_1$, $L_2$ and the upmix parameters $\alpha_{LU}$. The decoding section 700 comprises a decorrelating section 710 and a mixing section 720. The decorrelating section 710 receives the downmix signal $L_1$, $L_2$ and outputs, based thereon and in accordance with the upmix parameters (cf. equations (4) and (5)), a single-channel decorrelated signal D. The mixing section 720 determines a set of mixing coefficients based on the upmix parameters $\alpha_{LU}$, and forms the output signal $\widetilde{L_1}$, $\widetilde{L_2}$ as a linear combination of the downmix signal $L_1$, $L_2$ and the decorrelated signal D in accordance with the mixing coefficients. In other words, the mixing section 720 performs a projection from three channels to two channels.

In the present example embodiment, the decoding section 700 is configured to provide the output signal $\widetilde{L_1}$, $\widetilde{L_2}$ in accordance with the second coding format $F_2$ described with reference to FIG. 5, and therefore forms the output signal $\widetilde{L_1}$, $\widetilde{L_2}$ according to equation (5). In other words, the mixing coefficients correspond to the elements in the leftmost matrix of equation (5), and may be determined by the mixing section based on the upmix parameters $\alpha_{LU}$.

Hence, the mixing section 720 determines the mixing coefficients such that a first channel $\widetilde{L_1}$ of the output signal approximates a linear combination (e.g. a sum) of the third group 501 of channels of the five-channel audio signal L, LS, LB, TFL, TBL, and such that a second channel $\widetilde{L_2}$ of the output signal approximates a linear combination (e.g. a sum) of the fourth group of channels of the five-channel audio signal L, LS, LB, TFL, TBL. As described with reference to FIG. 5, the third and fourth groups 501, 502 constitute a partition of the five channels signal L, LS, LB, TFL, TBL of the five-channel audio signal, and both of the third and fourth groups 501, 502 comprise at least one channel from the first group 401 of channels.

In some example embodiments, the coefficients employed for parametric reconstruction of the five-channel audio signal L, LS, LB, TFL, TBL from the downmix signal $L_1$, $L_2$ and from a decorrelated signal may be represented by the upmix parameters $\alpha_{LU}$ in a compact form including fewer parameters than the number of actual coefficients employed for the parametric reconstruction. In such embodiments, the actual coefficients may be derived at the decoder side based on knowledge of the particular compact form employed.

Figure 8:
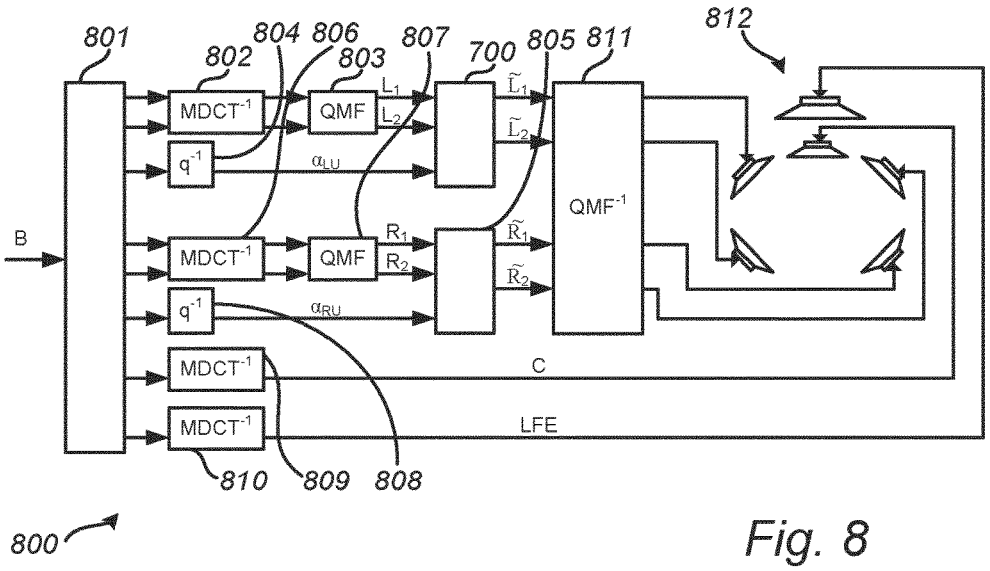
FIG. 8 is a generalized block diagram of an audio decoding system comprising the decoding section depicted in FIG. 7, according to an example embodiment.

FIG. 8 is a generalized block diagram of an audio decoding system 800 comprising the decoding section 700 described with reference to FIG. 7, according to an example embodiment.

A receiving section 801, e.g. including a demultiplexer, receives the bitstream B transmitted from the audio encoding system 200 described with reference to FIG. 2, and extracts the downmix signal $L_1$, $L_2$ and the associated upmix parameters $\alpha_{LU}$, the additional downmix signal $R_1$, $R_2$ and the associated additional upmix parameters $\alpha_{RU}$, as well as the channels C and LFE, from the bitstream B.

Although the mixing parameters $\alpha_{LM}$ and the additional mixing parameters $\alpha_{RM}$ may be available in the bitstream B, these parameters are not employed by the audio decoding system 800 in the present example embodiment. In other words, the audio decoding system 800 of the present example embodiment is compatible with bitstreams from which such mixing parameters may not be extracted. A decoding section employing the mixing parameters $\alpha_{LM}$ will be described further below with reference to FIG. 9.

In case the downmix signal $L_1$, $L_2$, the additional downmix signal $R_1$, $R_2$ and/or the channels C and LFE are encoded in the bitstream B using a perceptual audio codec such as Dolby Digital, MPEG AAC, or developments thereof, the audio decoding system 800 may comprise a core decoder (not shown in FIG. 8) configured to decode the respective signals and channels when extracted from the bitstream B.

A transform section 802 transforms the downmix signal $L_1$, $L_2$ by performing inverse MDCT and a QMF analysis section 803 transforms the downmix signal $L_1$, $L_2$ into a QMF domain for processing by the decoding section 700 of the downmix signal $L_1$, $L_2$ in the form of time/frequency tiles. A dequantization section 804 dequantizes the upmix parameters $\alpha_{LU}$, e.g., from an entropy coded format, before supplying them to the decoding section 700. As described with reference to FIG. 2, quantization may have been performed with one of two different step sizes, e.g. 0.1 or 0.2. The actual step size employed may be predefined, or may be signaled to the audio decoding system 800 from the encoder side, e.g. via the bitstream B.

In the present example embodiment, the audio decoding system 800 comprises an additional decoding section 805 analogous to the decoding section 700. The additional decoding section 805 is configured to receive the additional two-channel downmix signal $R_1$, $R_2$ described with reference to FIGS. 2 and 4, and the additional metadata including additional upmix parameters $\alpha_{RU}$ for parametric reconstruction of the additional five-channel audio signal R,RS,RB, TFR,TBR based on the additional downmix signal $R_1$, $R_2$. The additional decoding section 805 is configured to provide an additional two-channel output signal $\widetilde{R_1}$, $\widetilde{R_2}$ based on the downmix signal and the additional upmix paramaters $\alpha_{RU}$. The additional output signal $\widetilde{R_1}$, $\widetilde{R_2}$ provides a representation of the additional five-channel audio signal R, RS, RB, TFR, TBR conformal to the second coding format $F_2$ described with reference to FIG. 5.

A transform section 806 transforms the additional downmix signal $R_1$, $R_2$ by performing inverse MDCT and a QMF analysis section 807 transforms the additional downmix signal $R_1$, $R_2$ into a QMF domain for processing by the additional decoding section 805 of the additional downmix signal $R_1$, $R_2$ in the form of time/frequency tiles. A dequantization section 808 dequantizes the additional upmix parameters $\alpha_{RU}$, e.g., from an entropy coded format, before supplying them to the additional decoding section 805.

In example embodiments where a clip gain has been applied to the downmix signal $L_1$, $L_2$, the additional downmix signal $R_1$ $R_2$, and the channel C on an encoder side, a corresponding gain, e.g. corresponding to 8.7 dB, may be applied to these signals in the audio decoding system 800 to compensate the clip gain.

In the example embodiment described with reference to FIG. 8, the output signal $\widetilde{L_1}$, $\widetilde{L_2}$ and the additional output signal $\widetilde{R_1}$, $\widetilde{R_2}$ output by the decoding section 700 and the additional decoding section 805, respectively, are transformed back from the QMF domain by a QMF synthesis section 811 before being provided together with the channels C and LFE as output of the audio decoding system 800 for playback on multispeaker system 812 including e.g. five speakers and a subwoofer. Transform sections 809, 810 transform the channels C and LFE into the time domain by performing inverse MDCT before these channels are included in the output of the audio decoding system 800.

The channels C and LFE may for example be extracted from the bitstream B in a discretely coded form and the decoding system 800 may for example comprise single-channel decoding sections (not shown in FIG. 8) configured to the decode the respective discretely coded channels. The single-channel decoding section may for example include core decoders for decoding audio content encoded using a perceptual audio codec such as Dolby Digital, MPEG AAC, or developments thereof.

Figure 9:
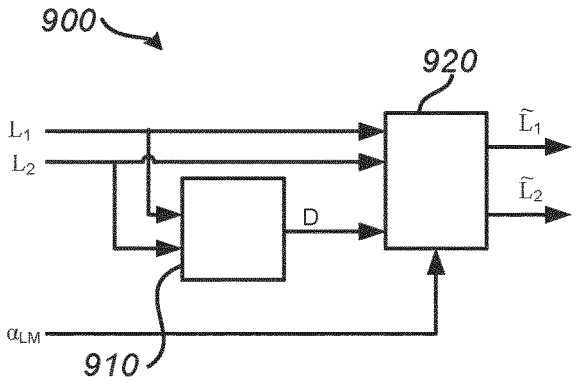
FIG. 9 is a generalized block diagram of a decoding section for providing a two-channel output signal based on a two-channel downmix signal and associated mixing parameters, according to an example embodiment.

FIG. 9 is a generalized block diagram of an alternative decoding section 900, according to an example embodiment. The decoding section 900 is similar to the decoding section 700 described with reference to FIG. 7 except that the decoding section 900 employs the mixing parameters $\alpha_{LM}$ provided by the encoding section 100, described with reference to FIG. 1, instead of employing the upmix parameters $\alpha_{LU}$ also provided by the encoding section 100.

Similarly to the decoding section 700, the decoding section 900 comprises a decorrelating section 910 and a mixing section 920. The decorrelating section 910 is configured to receive the downmix signal $L_1$, $L_2$, provided by the encoding section 100 described with reference to FIG. 1, and to output, based on the downmix signal $L_1$, $L_2$, a single-channel decorrelated signal D. The mixing section 920 determines a set of mixing coefficients based on the mixing parameters $\alpha_{LM}$, and forms an output signal $\widetilde{L_1}$, $\widetilde{L_2}$ as a linear combination of the downmix signal $L_1$, $L_2$ and the decorrelated signal D, in accordance with the mixing coefficients. The mixing section 920 determines the mixing parameters independently of the upmix parameters $\alpha_{LU}$ and forms the output signal $\widetilde{L_1}$, $\widetilde{L_2}$ by performing a projection from three to two channels.

In the present example embodiment, the decoding section 900 is configured to provide the output signal $\widetilde{L_1}$, $\widetilde{L_2}$ in accordance with the second coding format $F_2$, described with reference to FIG. 5 and therefore forms the output signal $\widetilde{L_1}$, $\widetilde{L_2}$ according to equation (9). In other words, the received mixing parameters $\alpha_{LM}$ may include the parameters $c_L$, $d_L$, $\gamma_L$ in the leftmost matrix of equation (9), and the mixing parameters $\alpha_{LM}$ may have been determined at the encoder side as described in relation to equation (9). Hence, the mixing section 920 determines the mixing coefficients such that a first channel $\widetilde{L_1}$ of the output signal approximates a linear combination (e.g. a sum) of the third group 501 of channels of the five-channel audio signal L, LS, LB, TFL, TBL described with reference to FIGS. 4 to 6, and such that a second channel $\widetilde{L_2}$ of the output signal approximates a linear combination (e.g. a sum) of the fourth group 502 of channels of the five-channel audio signal L, LS, LB, TFL, TBL.

The downmix signal $L_1$, $L_2$ and the mixing parameters $\alpha_{LM}$ may for example be extracted from the bitstream B output by the audio encoding system 200 described with reference to FIG. 2. The upmix parameters $\alpha_{LU}$ also encoded in the bitstream B may not be employed by the decoding section 900 of the present example embodiment, and therefore need not be extracted from the bitstream B.

Figure 10:
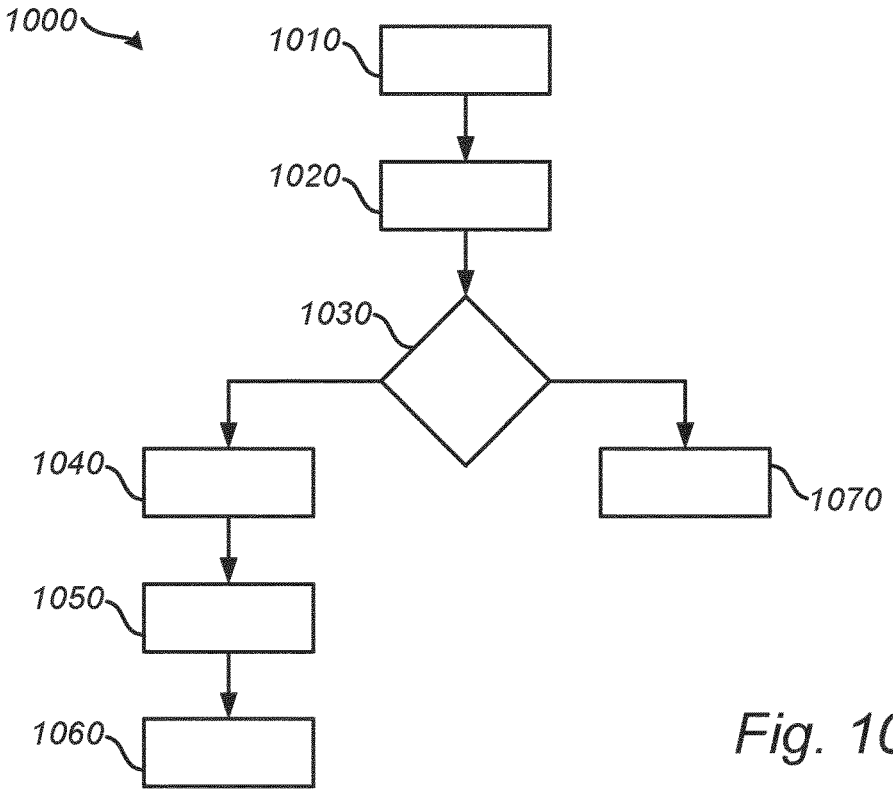
FIG. 10 is a flow chart of an audio decoding method for providing a two-channel output signal based on a two-channel downmix signal and associated metadata, according to an example embodiment.

FIG. 10 is a flow chart of an audio decoding method 1000 for providing a two-channel output signal based on a two-channel downmix signal and associated upmix parameters, according to an example embodiment. The decoding method 1000 may for example be performed by the audio decoding system 800 described with reference to FIG. 8.

The decoding method 1000 comprises receiving 1010 a two-channel downmix signal which is associated with metadata comprising upmix parameters for parametric reconstruction of the five-channel audio signal L, LS, LB, TFL, TBL, described with reference to FIGS. 4 to 6, based on the downmix signal. The downmix signal may for example be the downmix signal $L_1$, $L_2$ described with reference to FIG. 1, and may be conformal to the first coding format $F_1$, described with respect to FIG. 4. The decoding method 1000 further comprises receiving 1020 at least some of the metadata. The received metadata may for example include the upmix parameters $\alpha_{LU}$ and/or the mixing parameters $\alpha_{LM}$ described with reference to FIG. 1. The decoding method 1000 further comprises: generating 1040 a decorrelated signal based on at least one channel of the downmix signal; determining 1050 a set of mixing coefficients based on the received metadata; and forming 1060 a two-channel output signal as a linear combination of the downmix signal and the decorrelated signal, in accordance with the mixing coefficients. The two-channel output signal may for example be the two-channel output signal $\widetilde{L_1}$, $\widetilde{L_2}$, described with reference to FIGS. 7 and 8, and may be conformal to the second coding format $F_2$ described with reference to FIG. 5. In other words, the mixing coefficients may be determined such that: a first channel $\widetilde{L_1}$ of the output signal approximates a linear combination of the third group 501 of channels, and a second channel $\widetilde{L_2}$ of the output signal approximates a linear combination of the fourth group 502 of channels.

The decoding method 1000 may optionally comprise: receiving 1030 signaling indicating that the received downmix signal $L_1$, $L_2$ is conformal to one of the first coding format $F_1$ and the second coding format $F_2$, described with reference to FIGS. 4 and 5, respectively. The third and fourth groups 501, 502 may be predefined, and the mixing coefficients may be determined such that a single partition of the five-channel audio signal L, LS, LB, TFL, TBL into the third and fourth groups 501, 502 of channels, approximated by the channels of the output signal $\widetilde{L_1}$, $\widetilde{L_2}$, is maintained for both possible coding formats $F_1$, $F_2$ of the received downmix signal. The decoding method 1000 may optionally comprise passing 1070 the downmix signal $L_1$, $L_2$ through as the output signal $\widetilde{L_1}$, $\widetilde{L_2}$ (and/or suppressing contribution from the decorrelated signal to the output signal) in response to the signaling indicating that the received downmix signal is conformal the second coding format $F_2$, since then the coding format of the received downmix signal $L_1$, $L_2$ coincides with the coding format to be provided in the output signal $\widetilde{L_1}$, $\widetilde{L_2}$.

Figure 11:
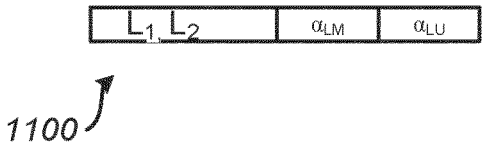
FIG. 11 schematically illustrates a computer-readable medium, according to an example embodiment.

FIG. 11 schematically illustrates a computer-readable medium 1100, according to an example embodiment. The computer-readable medium 1100 represents: the two-channel downmix signal $L_1$, $L_2$ described with reference to FIGS. 1 and 4; the upmix parameters $\alpha_{LU}$, described with reference to FIG. 1, allowing parametric reconstruction of the five-channel audio signal L, LS, LB, TFL, TBL based on the downmix signal $L_1$, $L_2$; and the mixing parameters $\alpha_{LM}$, described with reference to FIG. 1.

It will be appreciated that although the encoding section 100 described with reference to FIG. 1 is configured to encode the 11.1-channel audio signal in accordance with the first coding format $F_1$, and to provide mixing parameters $\alpha_{LM}$ for providing an output signal conformal to the second coding format $F_2$, similar encoding sections may be provided which are configured to encode the 11.1-channel audio signal in accordance with any one of the coding formats $F_1$, $F_2$, $F_3$, and to provide mixing parameters for providing an output signal conformal to any one of the first format $F_1$, $F_2$, $F_3$.

It will also be appreciated that although the decoding sections 700, 900, described with reference to FIGS. 7 and 9, are configured to provide an output signal conformal to the second coding format $F_2$ based on a downmix signal conformal to the first coding format $F_1$, similar decoding sections may be provided which are configured to provide an output signal conformal to any one of the coding formats $F_1$, $F_2$, $F_3$ based on a downmix signal conformal to any one of the coding formats $F_1$, $F_2$, $F_3$.

Since the sixth group 602 of channels, described with reference to FIG. 6, includes four channels, it will be appreciated that providing an output signal conformal to the first or second coding formats $F_1$, $F_2$ based on a downmix signal conformal to the third coding format $F_3$, may for example include: employing more than one decorrelated channel; and/or employing no more than one of the channels of the downmix signal as input to the decorrelating section.

It will be appreciated that although the examples described above have been formulated in terms of the 11.1-channel audio signal described with reference to FIGS. 4 to 6, encoding systems and decoding systems may be envisaged which include any number of encoding sections or decoding sections, respectively, and which may be configured to process audio signals comprising any number of M-channel audio signals.

Figure 12:
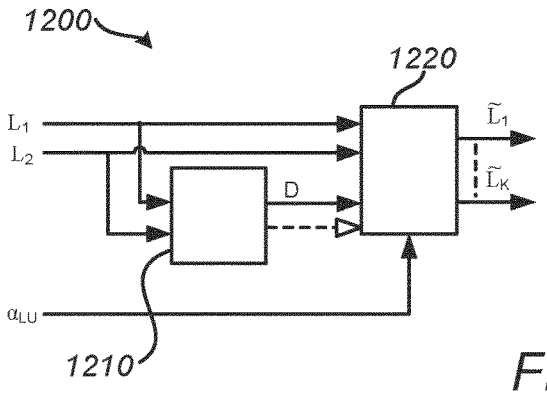
FIG. 12 is a generalized block diagram of a decoding section for providing a K-channel output signal based on a two-channel downmix signal and associated upmix parameters, according to an example embodiment.

FIG. 12 is a generalized block diagram of a decoding section 1200 for providing a K-channel output signal $\widetilde{L_1}, \ldots, \widetilde{L_K}$ based on a two-channel downmix signal $L_1$, $L_2$ and associated metadata, according to an example embodiment. The decoding section 1200 is similar to the decoding section 700, described with reference to FIG. 7, except that the decoding section 1200 provides a K-channel output signal $\widetilde{L_1}, \ldots, \widetilde{L_K}$, where $2 \leq K < M$, instead of a 2-channel output signal $\widetilde{L_1}$, $\widetilde{L_2}$.

More specifically, the decoding section 1200 is configured to receive a two-channel downmix signal $L_1$,$L_2$ which is associated with metadata, the metadata comprising upmix parameters $\alpha_{LU}$ for parametric reconstruction of an M-channel audio signal based on the downmix signal $L_1$, $L_2$, where $M \geq 4$. A first channel $L_1$ of the downmix signal $L_1$, $L_2$ corresponds to a linear combination (or sum) of a first group of one or more channels of the M-channel audio signal (e.g. the first group 401 described with reference to FIG. 4). A second channel $L_2$ of the downmix signal $L_1$, $L_2$ corresponds to a linear combination (or sum) of a second group (e.g. the second group 402, described with reference to FIG. 4) of one or more channels of the M-channel audio signal. The first and second groups constitute a partition of the M channels of the M-channel audio signal. In other words, the first and second groups are disjoint and together include all channels of the M-channel audio signal.

The decoding section 1200 is configured to receive at least a portion of the metadata (e.g. including the upmix parameters $\alpha_{LU}$), and to provide the K-channel output signal $\widetilde{L_1}, \ldots, \widetilde{L_K}$ based on the downmix signal $L_1$, $L_2$ and the received metadata. The decoding section 1200 comprises a decorrelating section 1210 configured to receive at least one channel of the downmix signal $L_1$, $L_2$ and to output, based thereon, a decorrelated signal D. The decoding section 1200 further comprises a mixing section 1220 configured to determine a set of mixing coefficients based on the received metadata, and to form the output signal $\widetilde{L_1}, \ldots, \widetilde{L_K}$ as a linear combination of the downmix signal $L_1$, $L_2$ and the decorrelated signal D in accordance with the mixing coefficients. The mixing section 1220 is configured to determine the mixing coefficients such that each of the K channels of the output signal $\widetilde{L_1}, \ldots, \widetilde{L_K}$ approximates a linear combination of a group of one or more channels of the M-channel audio signal. The mixing coefficients are determined such that the groups corresponding to the respective channels of the output signal $\widetilde{L_1}, \ldots, \widetilde{L_K}$ constitute a partition of the M channels of the M-channel audio signal into K groups of one or more channels, and such that at least two of these K groups comprise at least one channel from the first group of channels of the M-channel signal (i.e. the group corresponding to the first channel $L_1$ of the downmix signal).

The decorrelated signal D may for example be a single-channel signal. As indicated in FIG. 12, the decorrelated signal D may for example be a two-channel signal. In some example embodiments, the decorrelated signal D may comprise more than two channels.

The M-channel signal may for example be the five-channel signal L, LS, LB, TFL, TBL, described with reference to FIG. 4, and the downmix signal $L_1$, $L_2$ may for example be a two-channel representation of the five-channel signal L, LS, LB, TFL, TBL in accordance with any of the coding formats $F_1$, $F_2$, $F_3$ described with reference to FIGS. 4-6.

The audio decoding system 800, described with reference to FIG. 8, may for example comprise one or more decoding sections 1200 of the type described with reference to FIG. 12, instead of the decoding sections 700 and 805, and the multispeaker system 812 may for example include more than the five loudspeakers and a subwoofer described with reference to FIG. 8.

The audio decoding system 800 may for example be adapted to perform an audio decoding method similar to the audio decoding method 1000, described with reference to FIG. 10, except that a K-channel output signal is provided instead of a two-channel output signal.

Example implementations of the decoding section 1200 and the audio decoding system 800 will be described below with reference to FIGS. 12-16.

Similarly to FIGS. 4-6, FIGS. 12-13 illustrate alternative ways to partition an 11.1 channel audio signal into groups of one or more channels.

In order to represent the 11.1-channel (or 7.1+4-channel, or 7.1.4-channel) audio signal as a 7.1-channel (or 5.1+2-channel or 5.1.2-channel) audio signal, the collection of channels L, LS, LB, TFL, TBL, R, RS, RB, TFR, TBR, C, and LFE may be partitioned into groups of channels represented by respective channels. The five-channel audio signal L, LS, LB, TFL, TBL may be represented by a three-channel signal $L_1$, $L_2$, $L_3$, while the additional five-channel audio signal R, RS, RB, TFR, TBR may be represented by an additional three-channel signal $R_1$, $R_2$, $R_3$. The channels C and LFE may be kept as separate channels also in the 7.1-channel representation of the 11.1-channel audio signal.

Figure 13:
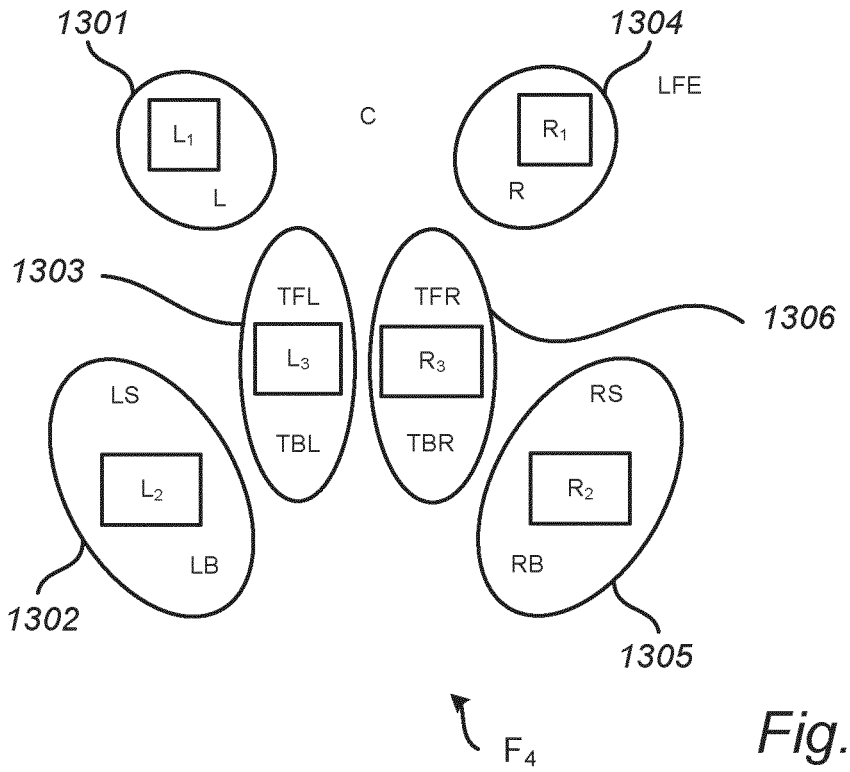
FIGS. 13-14 illustrate alternative ways to partition an 11.1-channel (or 7.1+4-channel or 7.1.4-channel) audio signal into groups of channels, according to example embodiments.

FIG. 13 illustrates a fourth coding format $F_4$ which provides a 7.1-channel representation of the 11.1-channel audio signal. In the fourth coding format $F_4$, the five-channel audio signal L, LS, LB, TFL, TBL is partitioned into a first group 1301 of channels only including the channel L, a second group 1302 of channels including the channels LS, LB, and a third group 1303 of channels including the channels TFL, TBL. The channels $L_1$, $L_2$, $L_3$ of the three-channel signal $L_1$, $L_2$, $L_3$ correspond to linear combinations (e.g. weighted or non-weighted sums) of the respective groups 1301, 1302, 1303 of channels. Similarly, the additional five-channel audio signal R, RS, RB, TFR, TBR is partitioned into an additional first group 1304 including the channel R, an additional second group 1305 including the channels RS, RB, and an additional third group 1306 including the channels TFR, TBR. The channels $R_1$, $R_2$, $R_3$ of the additional three-channel signal $R_1$, $R_2$, $R_3$ correspond to linear combinations (e.g. weighted or non-weighted sums) of the respective additional groups 1304, 1305, 1306 of channels.

The inventors have realized that metadata associated with a 5.1-channel representation of the 11.1-channel audio signal according to one of the first second and third coding formats $F_1$, $F_2$ $F_3$ may be employed to generate a 7.1-channel representation according to the fourth coding format $F_4$ without first reconstructing the original 11.1-channel signal. The five-channel signal L, LS, LB, TFL, TBL represents the left half-plane of the 11.1-channel audio signal, and the additional five-channel signal R, RS, RB, TFR, TBR represents the right half-plane, and may be treated analogously.

Recall that two channels $x_4$ and $x_5$ are reconstructable from the sum $m_2=x_4+x_5$ using equation (3).

If the second coding format $F_2$ is employed for providing a parametric representation of the 11.1-channel signal, and the fourth coding format $F_4$ is desired at a decoder side for 7.1-channel rendering of the audio content, then the approximation given by equation (1) may be applied once with $$x_1=TBL, x_2=LS, x_3=LB,$$

and once with $$x_1=TBR, x_2=RS, x_3=RB,$$

and the approximation given by equation (3) may be applied once with $$x_4=L, x_5=TFL,$$

and once with $$x_4=R, x_5=TFR.$$

Indicating the approximate nature of some of the left-side quantities (six channels of the output signal) by tildes, such application of the equations (1) and (3) yields $$\begin{bmatrix} \tilde{L}_1 \\ \tilde{R}_1 \\ C \\ \tilde{L}_2 \\ \tilde{R}_2 \\ \tilde{L}_3 \\ \tilde{R}_3 \end{bmatrix} = A \begin{bmatrix} L_1 \\ R_1 \\ C \\ L_2 \\ R_2 \\ D(L_1) \\ D(L_2) \\ D(R_1) \\ D(R_2) \end{bmatrix}, \tag{10}$$

where $$A = \begin{bmatrix} d_{1,L} & 0 & 0 & 0 & 0 & q_{1,L} & 0 & 0 & 0 \\ 0 & d_{1,R} & 0 & 0 & 0 & 0 & 0 & q_{1,R} & 0 \\ 0 & 0 & 1 & 0 & 0 & 0 & 0 & 0 & 0 \\ 0 & 0 & 0 & 1-c_{1,L} & 0 & 0 & -p_{1,L} & 0 & 0 \\ 0 & 0 & 0 & 0 & 1-c_{1,R} & 0 & 0 & 0 & -p_{1,R} \\ 1-d_{1,L} & 0 & 0 & c_{1,L} & 0 & -q_{1,L} & p_{1,L} & 0 & 0 \\ 0 & 1-d_{1,R} & 0 & 0 & c_{1,R} & 0 & 0 & -q_{1,R} & p_{1,R} \end{bmatrix}$$

and where, according to the fourth coding format $F_4$, $$\widetilde{L_1} \approx L,\ \widetilde{L_2} \approx LS+LB,\ \widetilde{L_3} \approx TFL+TBL,$$

$$\widetilde{R_1} \approx R\ \widetilde{R_2} \approx RS+RB,\ \widetilde{R_3} \approx TFR+TBR.$$

In the above matrix A, the parameters $c_{1,L}$, $p_{1,L}$, and $c_{1,R}$, $p_{1,R}$ are left-channel and right-channel versions, respectively, of the upmix parameters $c_1$, $p_1$ from equation (1), the parameters $d_{1,L}$, $q_{1,L}$ and $d_{1,R}$, $q_{1,R}$ are left-channel and right-channel versions, respectively, of the upmix parameters $d_1$, $q_1$ from equation (3), and D denotes a decorrelation operator. Hence, an approximation of the fourth coding format $F_4$ may be obtained from the second coding format $F_2$ based on upmix parameters (e.g. the upmix parameters $\alpha_{LU}$, $\alpha_{RU}$ described with reference to FIGS. 1 and 2) for parametric reconstruction of the 11.1-channel audio signal without actually having to reconstruct the 11.1-channel audio signal.

Two instances of the decoding section 1200, described with reference to FIG. 12 (with K=3, M=5 and a two-channel decorrelated signal D), may provide the three-channel output signals $\widetilde{L_1}, \widetilde{L_2}, \widetilde{L_3}$ and $\widetilde{R_1}, \widetilde{R_2}, \widetilde{R_3}$ approximating the three-channel signals $L_1$, $L_2$, $L_3$ and $R_1$, $R_2$, $R_3$ of the fourth coding format $F_4$. More specifically, the mixing sections 1220 of the decoding sections 1200 may determine mixing coefficients based on the upmix parameters in accordance with matrix A from equation (10). An audio decoding system similar to the audio decoding system 800, described with reference to FIG. 8, may employ the two such decoding sections 1200 to provide a 7.1-channel representation of the 11.1 audio signal for 7.1-channel playback.

If the first coding format $F_1$ is employed for providing a parametric representation of the 11.1-channel signal, and the fourth coding format $F_4$ is desired at a decoder side for rendering of the audio content, then the approximation given by equation (1) may be applied once with $$x_1=L,\ x_2=LS,\ x_3=LB,$$

and once with $$x_1=R,\ x_2=RS,\ x_3=RB.$$

Indicating the approximate nature of some of the left-side quantities (six channels of the output signal) by tildes, such application of the equation (1) yields $$\begin{bmatrix} \tilde{L}_1 \\ \tilde{R}_1 \\ C \\ \tilde{L}_2 \\ \tilde{R}_2 \\ \tilde{L}_3 \\ \tilde{R}_3 \end{bmatrix} = \begin{bmatrix} c_{1,L} & 0 & 0 & 0 & 0 & p_{1,L} & 0 & 0 \\ 0 & c_{1,R} & 0 & 0 & 0 & 0 & p_{1,R} & 0 \\ 0 & 0 & 1 & 0 & 0 & 0 & 0 & 0 \\ 1-c_{1,L} & 0 & 0 & 0 & 0 & -p_{1,L} & 0 & 0 \\ 0 & 1-c_{1,R} & 0 & 0 & 0 & 0 & -p_{1,R} & 0 \\ 0 & 0 & 0 & 1 & 0 & 0 & 0 & 0 \\ 0 & 0 & 0 & 0 & 1 & 0 & 0 & 0 \end{bmatrix} \begin{bmatrix} L_1 \\ R_1 \\ C \\ L_2 \\ R_2 \\ D(L_1) \\ D(L_2) \\ D(R_1) \\ D(R_2) \end{bmatrix} \quad (11)$$

where, according to the fourth coding format $F_4$, $\widetilde{L_1} \approx L$, $\widetilde{L_2} \approx LS+LB$, $\widetilde{L_3} = TFL+TBL$ (not approximated), $\widetilde{R_1} \approx R$, $\widetilde{R_2} \approx RS+RB$, $\widetilde{R_3} = TFR+TBR$ (not approximated).

In the above equation (11), the parameters $c_{1,L}$, $p_{1,L}$ and $c_{1,R}$, $p_{1,R}$ are left-channel and right-channel versions, respectively, of the parameters $c_1$, $p_1$ from equation (1), and D denotes a decorrelation operator. Hence, an approximation of the fourth coding format $F_4$ may be obtained from the first coding format $F_1$ based on upmix parameters for parametric reconstruction of the 11.1-channel audio signal, without actually having to reconstruct the 11.1-channel audio signal.

Two instances of the decoding section 1200, described with reference to FIG. 12 (with K=3 and M=5), may provide the three-channel output signals $\widetilde{L_1}, \widetilde{L_2}, \widetilde{L_3}$ and $\widetilde{R_1}, \widetilde{R_2}, \widetilde{R_3}$ approximating the three-channel signals $L_1$, $L_2$, $L_3$ and $R_1$, $R_2$, $R_3$ of the fourth coding format $F_4$. More specifically, the mixing sections 1220 of the decoding sections may determine mixing coefficients based on upmix parameters in accordance with equation (11). An audio decoding system similar to the audio decoding system 800, described with reference to FIG. 8, may employ the two such decoding sections 1200 to provide a 7.1-channel representation of the 11.1 audio signal for 7.1-channel playback.

As can be seen in equation (11), only two decorrelated channels are actually needed. Although the decorrelated channels $D(L_2)$ and $D(R_2)$ are not needed for providing the fourth coding format $F_4$ from the first coding format $F_1$, such decorrelators may for example be kept running (or be kept active) anyway, so that buffers/memories of the decorrelators are kept updated and available in case the coding format of the downmix signal changes to, for example, the second coding format $F_2$. Recall that four decorrelated channels are employed when providing the fourth coding format $F_4$ from the second coding format $F_2$ (see equation (10) and the associated matrix A).

If the third coding format $F_3$ is employed for providing a parametric representation of the 11.1-channel audio signal, and the fourth coding format $F_4$ is desired at a decoder side for rendering of the audio content, similar relations as those presented in equations (10) and (11) may be derived using the same ideas. An audio decoding system similar to the audio decoding system 800, described with reference to FIG. 8, may employ two decoding sections 1200 to provide a 7.1-channel representation of the 11.1 audio signal in accordance with the fourth coding format $F_4$.

In order to represent the 11.1-channel audio signal as a 9.1-channel (or 5.1+4-channel, or 5.1.4-channel) audio signal, the collection of channels L, LS, LB, TFL, TBL, R, RS, RB, TFR, TBR, C, and LFE may be partitioned into groups of channels represented by respective channels. The five-channel audio signal L, LS, LB, TFL, TBL may be represented by a four-channel signal $L_1$, $L_2$, $L_3$, $L_4$, while the additional five-channel audio signal R, RS, RB, TFR, TBR may be represented by an additional four-channel signal $R_1$, $R_2$, $R_3$, $R_4$. The channels C and LFE may be kept as separate channels also in the 9.1-channel representation of the 11.1-channel audio signal.

Figure 14:
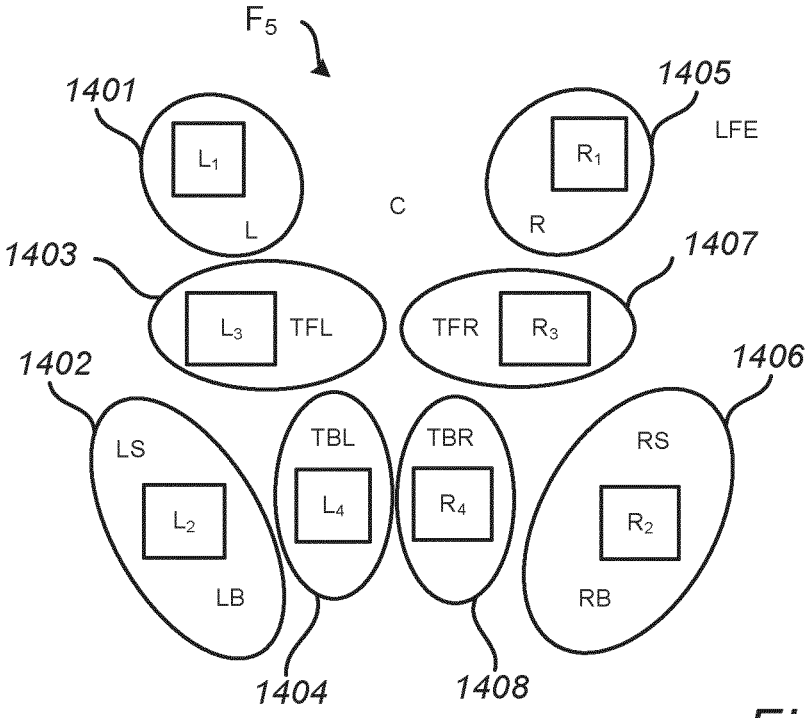

FIG. 14 illustrates a fifth coding format $F_5$ providing a 9.1-channel representation of an 11.1-channel audio signal. In the fifth coding format, the five-channel audio signal L, LS, LB, TFL, TBL is partitioned into a first group 1401 of channels only including the channel L, a second group 1402 of channels including the channels LS, LB, a third group 1403 of channels only including the channel TFL, and a fourth group 1404 of channels only including the channel TBL. The channels $L_1$, $L_2$, $L_3$, $L_4$ of the four-channel signal $L_1$, $L_2$, $L_3$, $L_4$ correspond to linear combinations (e.g. weighted or non-weighted sums) of the respective groups 1401, 1402, 1403, 1404 of one or more channels. Similarly, the additional five-channel audio signal R, RS, RB, TFR, TBR is partitioned into an additional first group 1405 including the channel R, an additional second group 1406 including the channels RS, RB, an additional third group 1407 including the channel TFR, and an additional fourth group 1408 including the channel TBR. The channels $R_1$, $R_2$, $R_3$, $R_4$ of the additional four-channel signal $R_1$, $R_2$, $R_3$, $R_4$ correspond to linear combinations (e.g. weighted or non-weighted sums) of the respective additional groups 1405, 1406, 1407, 1408 of one or more channels.

The inventors have realized that metadata associated with a 5.1-channel representation of the 11.1-channel audio signal according to one of the coding formats $F_1$, $F_2$ $F_3$ may be employed to generate a 9.1-channel representation according to the fifth coding format $F_5$ without first reconstructing the original 11.1-channel signal. The five-channel signal L, LS, LB, TFL, TBL representing the left half-plane of the 11.1-channel audio signal, and the additional five-channel signal R, RS, RB, TFR, TBR representing the right half-plane, may be treated analogously.

If the second coding format $F_2$ is employed for providing a parametric representation of the 11.1-channel signal, and the fifth coding format $F_5$ is desired at a decoder side for rendering of the audio content, then the approximation provided by equation (1) may be applied once with $$x_1=TBL,\ x_2=LS,\ x_3=LB,$$

and once with $$x_1=TBR,\ x_2=RS,\ x_3=RB,$$

and the approximation of equation (3) may be applied once with $$x_4=L,\ x_5=TFL,$$

and once with $$x_4=R,\ x_5=TFR.$$

Indicating the approximate nature of some of the left-side quantities (eight channels of the output signal) by tildes, such application of the equations (1) and (3) yields $$\begin{bmatrix} \tilde{L}_1 \\ \tilde{R}_1 \\ C \\ \tilde{L}_2 \\ \tilde{R}_2 \\ \tilde{L}_3 \\ \tilde{R}_3 \\ \tilde{L}_4 \\ \tilde{R}_4 \end{bmatrix} = A \begin{bmatrix} L_1 \\ R_1 \\ C \\ L_2 \\ R_2 \\ D(L_1) \\ D(L_2) \\ D(R_1) \\ D(R_2) \end{bmatrix}, \tag{12}$$

where $$A = \begin{bmatrix} d_{1,L} & 0 & 0 & 0 & 0 & q_{1,L} & 0 & 0 & 0 \\ 0 & d_{1,R} & 0 & 0 & 0 & 0 & 0 & q_{1,R} & 0 \\ 0 & 0 & 1 & 0 & 0 & 0 & 0 & 0 & 0 \\ 0 & 0 & 0 & 1-c_{1,L} & 0 & 0 & -p_{1,L} & 0 & 0 \\ 0 & 0 & 0 & 0 & 1-c_{1,R} & 0 & 0 & 0 & -p_{1,R} \\ 1-d_{1,L} & 0 & 0 & 0 & 0 & -q_{1,L} & 0 & 0 & 0 \\ 0 & 1-d_{1,R} & 0 & 0 & 0 & 0 & 0 & -q_{1,R} & 0 \\ 0 & 0 & 0 & c_{1,L} & 0 & 0 & p_{1,L} & 0 & 0 \\ 0 & 0 & 0 & 0 & c_{1,R} & 0 & 0 & 0 & p_{1,R} \end{bmatrix},$$

and where, according to the fifth coding format $F_5$, $$\widetilde{L_1} \approx L,\ \widetilde{L_2} \approx LS+LB,\ \widetilde{L_3} \approx TFL,\ \widetilde{L_4} \approx TBL$$

$$\widetilde{R_1} \approx R\ \widetilde{R_2} \approx RS+RB,\ \widetilde{R_3} \approx TFR,\ \widetilde{R_4} \approx TBR.$$

In the above matrix A, the parameters $c_{1,L}$, $p_{1,L}$ and $c_{1,R}$, $p_{1,R}$ are left-channel and right-channel versions, respectively, of the upmix parameters $c_1$, $p_1$ from equation (1), $d_{1,L}$, $q_{1,L}$ and $d_{1,R}$, $q_{1,R}$ are left-channel and right-channel versions, respectively, of the upmix parameters $d_1$, $q_1$ from equation (3), and D denotes a decorrelation operator. Hence, an approximation of the fifth coding format $F_5$ may be obtained from the second coding format $F_2$ based on upmix parameters for parametric reconstruction of the 11.1-channel audio signal, without actually having to reconstruct the 11.1-channel audio signal.

Two instances of the decoding section 1200, described with reference to FIG. 12 (with K=4 and M=5 and a two-channel decorrelated signal D), may provide the four-channel output signals $\widetilde{L_1}, \widetilde{L_2}, \widetilde{L_3}, \widetilde{L_4}$ and $\widetilde{R_1}, \widetilde{R_2}, \widetilde{R_3}, \widetilde{R_4}$ approximating the four-channel signals $L_1$, $L_2$, $L_3$, $L_4$ and $R_1$, $R_2$, $R_3$, $R_4$, of the fifth coding format $F_5$. More specifically, the mixing sections 1220 of the decoding sections may determine mixing coefficients based on upmix parameters in accordance with equation (12). An audio decoding system similar to the audio decoding system 800, described with reference to FIG. 8, may employ two such decoding sections 1200 to provide a 9.1-channel representation of the 11.1 audio signal for 9.1-channel playback.

If the first $F_1$ or third $F_3$ coding format is employed for providing a parametric representation of the 11.1-channel audio signal, and the fifth coding format $F_5$ is desired at a decoder side for rendering of the audio content, similar relations as the relation presented in equation (12) may be derived using the same ideas.

Figure 15:
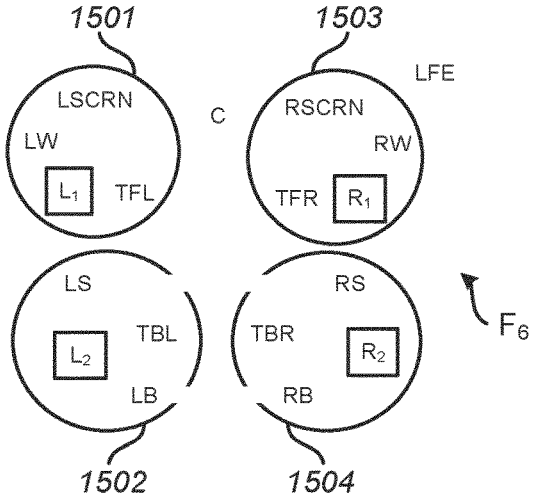
FIGS. 15-16 illustrate alternative ways to partition a 13.1-channel (or 9.1+4-channel or 9.1.4-channel) audio signal into groups of channels, according to example embodiments.
Figure 16:
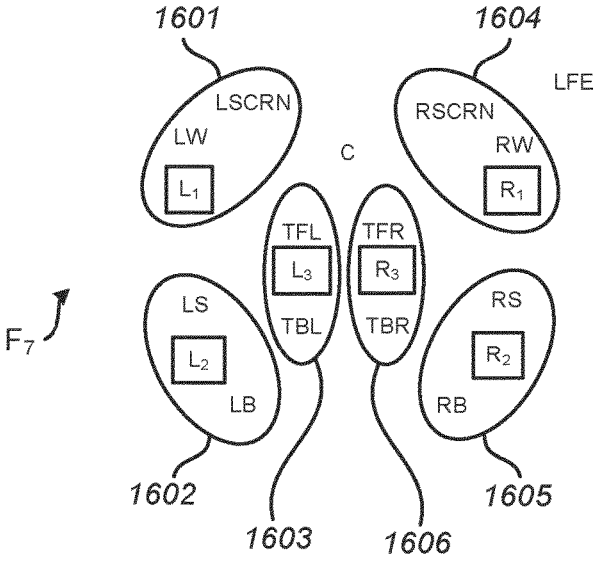

FIGS. 15-16 illustrate alternative ways to partition a 13.1-channel (or 9.1+4-channel, or 9.1.4-channel) audio signal into groups of channels for representing the 13.1-channel audio signal as a 5.1-channel audio signal, and a 7.1-channel signal, respectively.

The 13.1-channel audio signal comprises the channels LW (left wide), LSCRN (left screen), LS (left side), LB (left back), TFL (top front left), TBL (top back left), RW (right wide), RSCRN (right screen), RS (right side), RB (right back), TFR (top front right), TBR (top back right), C (center), and LFE (low frequency effects). The six channels LW, LSCRN, LS, LB, TFL and TBL form a six-channel audio signal representing a left half-space in a playback environment of the 13.1-channel audio signal. The four channels LW, LSCRN, LS and LB represent different horizontal directions in the playback environment and the two channels TFL and TBL represent directions vertically separated from those of the four channels LW, LSCRN, LS and LB. The two channels TFL and TBL may for example be intended for playback in ceiling speakers. Similarly, the six channels RW, RSCRN, RS, RB, TFR and TBR form an additional six-channel audio signal representing a right half-space of the playback environment, the four channels RW, RSCRN, RS and RB representing different horizontal directions in the playback environment and the two channels TFR and TBR representing directions vertically separated from those of the four channels RW, RSCRN, RS and RB.

FIG. 15 illustrates a sixth coding format $F_6$, in which the six-channel audio signal LW, LSCRN, LS, LB, TFL, TBL is partitioned into a first group 1501 of channels LW, LSCRN, TFL and a second group 1502 of channels LS, LB, TBL, and in which the additional six-channel audio signal RW, RSCRN, RS, RB, TFR, TBR is partitioned into an additional first group 1503 of channels RW, RSCRN, TFR and an additional second group 1504 of channels RS, RB, TBR. The channels $L_1$, $L_2$ of a two-channel downmix signal $L_1$, $L_2$ correspond to linear combinations (e.g. weighted or non-weighted sums) of the respective groups 1501, 1502 of channels. Similarly, the channels $R_1$, $R_2$ of an additional two-channel downmix signal $R_1$, $R_2$ correspond to linear combinations (e.g. weighted or non-weighted sums) of the respective additional groups 1503, 1504 of channels.

FIG. 16 illustrates a seventh coding format $F_7$, in which the six-channel audio signal LW, LSCRN, LS, LB, TFL, TBL is partitioned into a first group 1601 of channels LW, LSCRN, a second group 1602 of channels LS, LB and a third group 1603 of channels TFL, TBL, and in which the additional six-channel audio signal RW, RSCRN, RS, RB, TFR, TBR is partitioned into an additional first group 1604 of channels RW, RSCRN, an additional second group 1605 of channels RS,RB, and an additional third group 1606 of channels TFR,TBR. Three channels $L_1$, $L_2$, $L_3$ correspond to linear combinations (e.g. weighted or non-weighted sums) of the respective groups 1601, 1602, 1603 of channels. Similarly, three additional channels $R_1$, $R_2$, $R_3$ correspond to linear combinations (e.g. weighted or non-weighted sums) of the respective additional groups 1604, 1605, 1606 of channels.

The inventors have realized that metadata associated with a 5.1-channel representation of the 13.1-channel audio signal according the sixth coding format $F_6$ may be employed to generate a 7.1-channel representation according to the seventh coding format $F_7$ without first reconstructing the original 13.1-channel signal. The six-channel signal LW, LSCRN, LS, LB, TFL, TBL representing the left half-plane of the 13.1-channel audio signal, and the additional six-channel signal RW, RSCRN, RS, RB, TFR, TBR representing the right half-plane, may be treated analogously.

Recall that two channels $x_4$ and $x_5$ are reconstructable from the sum $m_2=x_4+x_5$ using equation (3).

If the sixth coding format $F_6$ is employed for providing a parametric representation of the 13.1-channel signal, and the seventh coding format $F_7$ is desired at a decoder side for 7.1-channel (or 5.1+2-channel or 5.1.2-channel) rendering of the audio content, then the approximation given by equation (1) may be applied four times, once with $$x_1=TBL,\ x_2=LS,\ x_3=LB,$$

once with $$x_1=TBR,\ x_2=RS,\ x_3=RB,$$

once with $$x_1=TFL,\ x_2=LW,\ x_3=\mathrm{LSCRN},$$

and once with $$x_1=TFR,\ x_2=RW,\ x_3=\mathrm{RSCRN},$$

Indicating the approximate nature of some of the left-side quantities (six channels of the output signal) by tildes, such application of the equation (1) yields $$\begin{bmatrix} \tilde{L}_1 \\ \tilde{R}_1 \\ C \\ \tilde{L}_2 \\ \tilde{R}_2 \\ \tilde{L}_3 \\ \tilde{R}_3 \end{bmatrix} = A \begin{bmatrix} L_1 \\ R_1 \\ C \\ L_2 \\ R_2 \\ D(L_1) \\ D(L_2) \\ D(R_1) \\ D(R_2) \end{bmatrix}, \tag{13}$$

where $$A = \begin{bmatrix} 1-c_{1,L} & 0 & 0 & 0 & 0 & -p_{1,L} & 0 & 0 & 0 \\ 0 & 1-c_{1,R} & 0 & 0 & 0 & 0 & 0 & -p_{1,R} & 0 \\ 0 & 0 & 1 & 0 & 0 & 0 & 0 & 0 & 0 \\ 0 & 0 & 0 & 1-c'_{1,L} & 0 & 0 & -p'_{1,L} & 0 & 0 \\ 0 & 0 & 0 & 0 & 1-c'_{1,R} & 0 & 0 & 0 & -p'_{1,R} \\ c_{1,L} & 0 & 0 & c'_{1,L} & 0 & p_{1,L} & p'_{1,L} & 0 & 0 \\ 0 & c_{1,R} & 0 & 0 & c'_{1,R} & 0 & 0 & p_{1,R} & p'_{1,R} \end{bmatrix}$$

and where, according to the seventh coding format $F_7$, $$\widetilde{L_1} \approx LW+\text{LSCRN},\ \widetilde{L_2} \approx LS+LB,\ \widetilde{L_3} \approx TFL+TBL,$$

$$\widetilde{R_1} \approx RW+\text{RSCN}\ \widetilde{R_2} \approx RS+RB,\ \widetilde{R_3} \approx TFR+TBR.$$

In the above matrix A, the parameters $c_{1,L}$, $p_{1,L}$ and $c'_{1,L}$, $p'_{1,L}$ are two different instances of the upmix parameters $c_1$, $p_1$ from equation (1) for the left side, the parameters $c_{1,R}$, $p_{1,R}$ and $c'_{1,R}$, $p'_{1,R}$ are two different instances of the upmix parameters $c_1$, $p_1$ and from equation (1) for the right side, and D denotes a decorrelation operator. Hence, an approximation of the seventh coding format $F_7$ may be obtained from the sixth coding format $F_6$ based on upmix parameters for parametric reconstruction of the 13.1-channel audio signal without actually having to reconstruct the 13.1-channel audio signal.

Two instances of the decoding section 1200, described with reference to FIG. 12 (with K=3, M=6, and a two-channel decorrelated signal D), may provide the three-channel output signals $\widetilde{L_1}, \widetilde{L_2}, \widetilde{L_3}$ and $\widetilde{R_1}, \widetilde{R_2}, \widetilde{R_3}$ approximating the three-channel signals $L_1$, $L_2$, $L_3$ and $R_1$, $R_2$, $R_3$ of the seventh coding format $F_7$, based on two-channel downmix signals generated on an encoder side in accordance with in the sixth coding format $F_6$. More specifically, the mixing sections 1220 of the decoding sections 1200 may determine mixing coefficients based on upmix parameters in accordance with matrix A from equation (13). An audio decoding system similar to the audio decoding system 800, described with reference to FIG. 8, may employ the two such decoding sections 1200 to provide a 7.1-channel representation of the 13.1 audio signal for 7.1-channel playback.

As can be seen in equations (10)-(13) (and the associated matrices A), if two channels of the output signal (e.g. the channels $\widetilde{L_1}$ and $\widetilde{L_2}$ in equation (11)) receive contributions from the same decorrelated channel (e.g. $D(L_1)$ in equation (11)), then these two contributions have equal magnitude, but of opposite signs (e.g. indicated by the mixing coefficients $p_{1,L}$ and $-p_{1,L}$ in equation (11)).

As can be seen in equations (10)-(13) (and the associated matrices A), if two channels of the output signal (e.g. the channels $\widetilde{L_1}$ and $\widetilde{L_2}$ in equation (11)) receive contributions from the same downmix channel (e.g. the channel $L_1$ in equation (11)), then the sum of the two mixing coefficients controlling these two contributions (e.g. the mixing coefficients $c_{1,L}$ and $1-c_{1,L}$ in equation (11)) has the value 1.

As described above with reference to FIGS. 12-16, the decoding section 1200 may provide a K-channel output signal $\widetilde{L_1}, \ldots, \widetilde{L_K}$ based on a two-channel downmix signal $L_1$, $L_2$ and upmix parameters $\alpha_{LU}$. The upmix parameters $\alpha_{LU}$ may be adapted for parametric reconstruction of an original M-channel audio signal, and the mixing section 1220 of the decoding section 1200 may be able to compute suitable mixing parameters, based on the upmix parameters $\alpha_{LU}$, for providing the K-channel output signal $\widetilde{L_1}, \ldots, \widetilde{L_K}$ without reconstructing the M-channel audio signal.

In some example embodiments, dedicated mixing parameters $\alpha_{LM}$ may be sent from an encoder side for facilitating provision of the K-channel output signal $\widetilde{L_1}, \ldots, \widetilde{L_K}$ at the decoder side.

For example, the decoding section 1200 may be configured similarly to the decoding section 900 described above with reference to FIG. 9.

For example, the decoding section 1200 may receive mixing parameters $\alpha_{LM}$ in the form of the elements (or mixing coefficients) of one or more of the mixing matrices of shown in equations (10)-(13) (i.e. the matrices denoted A). In such an example, there may be no need for the decoding section 1200 to compute any of the elements in the mixing matrices in equations (10)-(13).

Example embodiments may be envisaged in which the analysis section 120, described with reference to FIG. 1 (and similarly the additional analysis section 203, described with reference to FIG. 2), determines mixing parameters $\alpha_{LM}$ for obtaining, based on the downmix signal $L_1$, $L_2$, a K-channel output signal, where $2 \leq K < M$. The mixing parameters $\alpha_{LM}$ may for example be provided in the form of the elements (or mixing coefficients) of one or more of the mixing matrices of equations (10)-(13) (i.e. the matrices denoted A).

Multiple sets of mixing parameters $\alpha_{LM}$ may for example be provided, where the respective sets of mixing parameters $\alpha_{LM}$ are intended for different types of rendering at a decoder side. For example, the audio encoding system 200, described above with reference to FIG. 2, may provide a bitstream B in which a 5.1 downmix representation of an original 11.1-channel audio signal is provided, and in which sets of mixing parameters $\alpha_{LM}$ may be provided for 5.1-channel rendering (according to the first, second and/or third coding formats $F_1$, $F_2$, $F_3$), for 7.1-channel rendering (according to the fourth coding format $F_4$) and/or for 9.1-channel rendering (according to the fifth coding format $F_5$).

The audio encoding method 300, described with reference to FIG. 3 may for example include determining 340 mixing parameters $\alpha_{LM}$ for obtaining, based on the downmix signal $L_1$, $L_2$, a K-channel output signal, where $2 \leq K < M$.

Example embodiments may be envisaged in which the computer-readable medium 1100, described with reference to FIG. 11, represents: a two-channel downmix signal (e.g. the two-channel downmix signal $L_1$, $L_2$ described with reference to FIGS. 1 and 4); upmix parameters (e.g. the upmix parameters $\alpha_{LU}$, described with reference to FIG. 1) allowing parametric reconstruction of an M-channel audio signal (e.g. the five-channel audio signal L, LS, LB, TFL, TBL) based on the downmix signal; and mixing parameters $\alpha_{LM}$ allowing for provision of a K-channel output signal based on the downmix signal. As described above, $M \geq 4$ and $2 \leq K < M$.

It will be appreciated that although the examples described above have been formulated in terms of original audio signals with M=5 and M=6 channels, and output signals with K=2, K=3 and K=4 channels, similar encoding systems (and encoding sections) and decoding systems (and decoding sections) may be envisaged for any M and K satisfying $M \geq 4$ and $2 \leq K < M$.

V. Equivalents, Extensions, Alternatives and Miscellaneous

Even though the present disclosure describes and depicts specific example embodiments, the invention is not restricted to these specific examples. Modifications and variations to the above example embodiments can be made without departing from the scope of the invention, which is defined by the accompanying claims only.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs appearing in the claims are not to be understood as limiting their scope.

The devices and methods disclosed above may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out in a distributed fashion, by several physical components in cooperation. Certain components or all components may be implemented as software executed by a digital processor, signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

VI. List of Examples

1. An audio decoding method (1000) comprising:

receiving (1010) a two-channel downmix signal ($L_1$, $L_2$), which is associated with metadata, the metadata comprising upmix parameters ($\alpha_{LU}$) for parametric reconstruction of an M-channel audio signal (L, LS, LB, TFL, TBL) based on the downmix signal, where M≥4, wherein a first ($L_1$) channel of the downmix signal corresponds to a linear combination of a first group (401) of one or more channels of the M-channel audio signal, wherein a second channel ($L_2$) of the downmix signal corresponds to a linear combination of a second group (402) of one or more channels of the M-channel audio signal, and wherein the first and second groups constitute a partition of the M channels of the M-channel audio signal;

receiving (1020) at least a portion of said metadata;

generating (1040) a decorrelated signal (D) based on at least one channel of the downmix signal;

determining (1050) a set of mixing coefficients based on the received metadata; and forming (1060) a two-channel output signal ($\widetilde{L_1}$, $\widetilde{L_2}$) as a linear combination of the downmix signal and the decorrelated signal in accordance with the mixing coefficients, wherein the mixing coefficients are determined such that:

a first channel ($\widetilde{L_1}$) of the output signal approximates a linear combination of a third group (501) of one or more channels of the M-channel audio signal;

a second channel ($\widetilde{L_2}$) of the output signal approximates a linear combination of a fourth group (502) of one or more channels of the M-channel audio signal;

the third and fourth groups constitute a partition of the M channels of the M-channel audio signal; and both of the third and fourth groups comprise at least one channel from said first group.

2. The audio decoding method of example 1, wherein the received metadata includes the upmix parameters and wherein the mixing coefficients are determined by processing the upmix parameters.

3. The audio decoding method of example 1, wherein the received metadata includes mixing parameters ($\alpha_{LM}$) distinct from the upmix parameters.

4. The audio decoding method of example 3, wherein the mixing coefficients are determined independently of any values of the upmix parameters.

5. The audio decoding method of any of the preceding examples, wherein M=5.

6. The audio decoding method of any of the preceding examples, wherein each gain controlling a contribution from a channel of the M-channel audio signal to one of the linear combinations, to which the channels of the downmix signal correspond, coincides with a gain controlling a contribution from said channel of the M-channel audio signal to one of the linear combinations approximated by the channels of the output signal.

7. The audio decoding method of any of the preceding examples, further comprising an initial step of receiving a bitstream (B) representing the downmix signal and the metadata, wherein the downmix signal and said received metadata are extracted from the bitstream.

8. The audio decoding method of any of the preceding examples, wherein the decorrelated signal is a single-channel signal and wherein said output signal is formed by including no more than one decorrelated signal channel into said linear combination of the downmix signal and the decorrelated signal.

9. The audio decoding method of example 8, wherein the mixing coefficients are determined such that the two channels of the output signal receive contributions of equal magnitude from the decorrelated signal, the contributions from the decorrelated signal to the respective channel of the output signal having opposite signs.

10. The audio decoding method of any of examples 8-9, wherein forming the output signal amounts to a projection from three channels to two channels.

11. The audio decoding method of any of the preceding examples, wherein the mixing coefficients are determined such that a sum of a mixing coefficient controlling a contribution from the first channel of the downmix signal to the first channel of the output signal, and a mixing coefficient controlling a contribution from the first channel of the downmix signal to the second channel of the output signal, has the value 1.

12. The audio decoding method of any of the preceding examples, wherein said first group consists of two or three channels.

13. The audio decoding method of any of the preceding examples, wherein the M-channel audio signal comprises three channels (L, LS, LB) representing different horizontal directions in a playback environment for the M-channel audio signal, and two channels (TFL, TBL) representing directions vertically separated from those of said three channels in said playback environment.

14. The audio decoding method of example 13, wherein said first group consists of said three channels, and wherein said second group consists of said two channels.

15. The audio decoding method of example 14, wherein one of said third and fourth groups comprises both of said two channels.

16. The audio decoding method of example 14, wherein each of said third and fourth groups comprises one of said two channels.

17. The audio decoding method of any of the preceding examples, wherein the decorrelated signal is obtained by processing a linear combination of the channels of the downmix signal.

18. The audio decoding method of any of examples 1-15, wherein the decorrelated signal is obtained based on no more than one channel of the downmix signal.

19. The audio decoding method of any of examples 1-2 and 5-18, wherein said first group consists of N channels, where N≤3, wherein said first group is reconstructable as a linear combination of said first channel of the downmix signal and an (N−1)-channel decorrelated signal by applying dry upmix coefficients to said first channel of the downmix signal and wet upmix coefficients to channels of the (N−1)-channel decorrelated signal, wherein the received metadata includes wet upmix parameters and dry upmix parameters, and wherein determining the mixing coefficients comprises:

determining, based on the dry upmix parameters, the dry upmix coefficients;

populating an intermediate matrix having more elements than the number of received wet upmix parameters, based on the received wet upmix parameters and knowing that the intermediate matrix belongs to a predefined matrix class;

obtaining the wet upmix coefficients by multiplying the intermediate matrix by a predefined matrix, wherein the wet upmix coefficients corresponds to the matrix resulting from the multiplication and includes more coefficients than the number of elements in the intermediate matrix; and processing the wet and dry upmix coefficients.

20. The audio decoding method of any of the preceding examples, further comprising:

receiving signaling (1030) indicating one of at least two coding formats ($F_1$, $F_2$, $F_3$) of the M-channel audio signal, the coding formats corresponding to respective different partitions of the channels of the M-channel audio signal into respective first and second groups associated with the channels of the downmix signal, wherein said third and fourth groups are predefined, and wherein the mixing coefficients are determined such that a single partition of the M-channel audio signal into said third and fourth groups of channels, approximated by the channels of the output signal, is maintained for said at least two coding formats.

21. The audio decoding method of example 20, further comprising:

passing (1070) the downmix signal through as said output signal, in response to said signaling indicating a particular coding format ($F_2$), the particular coding format corresponding to a partition of the channels of the M-channel audio signal coinciding with a partition which said third and fourth groups define.

22. The audio decoding method of example 20, further comprising:

suppressing the contribution from the decorrelated signal to said output signal, in response to said signaling indicating a particular coding format, the particular coding format corresponding to a partition of the channels of the M-channel audio signal coinciding with a partition which said third and fourth groups define.

23. The audio decoding method of any of examples 20-22, wherein:

in a first coding format ($F_1$), said first group consists of three channels (L, LS, LB) representing different horizontal directions in a playback environment for the M-channel audio signal, and said second group consists of two channels (TFL, TBL) representing directions vertically separated from those of said three channels in said playback environment; and in a second coding format ($F_2$), each of said first and second groups comprises one of said two channels.

24. An audio decoding system (800) comprising a decoding section (700) configured to:

receive a two-channel downmix signal ($L_1$, $L_2$), which is associated with metadata, the metadata comprising upmix parameters ($\alpha_{LU}$) for parametric reconstruction of an M-channel audio signal (L, LS, LB, TFL, TBL) based on the downmix signal, where M≤4, wherein a first channel ($L_1$) of the downmix signal corresponds to a linear combination of a first group (401) of one or more channels of the M-channel audio signal, wherein a second channel ($L_2$) of the downmix signal corresponds to a linear combination of a second group (402) of one or more channels (TFL, TBL) of the M-channel audio signal, and wherein the first and second groups constitute a partition of the M channels of the M-channel audio signal;

receive at least a portion of said metadata; and provide a two-channel output signal ($\widetilde{L_1}$, $\widetilde{L_2}$) based on the downmix signal and the received metadata, the decoding section comprising:

a decorrelating section (710) configured to receive at least one channel of the downmix signal and to output, based thereon, a decorrelated signal (D); and a mixing section (720) configured to determine a set of mixing coefficients based on the received metadata, and form the output signal as a linear combination of the downmix signal and the decorrelated signal in accordance with the mixing coefficients, wherein the mixing section is configured to determine the mixing coefficients such that:

a first channel ($\widetilde{L_1}$) of the output signal approximates a linear combination of a third group (501) of one or more channels of the M-channel audio signal;

a second channel ($\widetilde{L_2}$) of the output signal approximates a linear combination of a fourth group (502) of one or more channels of the M-channel audio signal;

the third and fourth groups constitute a partition of the M channels of the M-channel audio signal; and both of the third and fourth groups comprise at least one channel from said first group.

25. The audio decoding system of example 24, further comprising an additional decoding section (805) configured to:

receive an additional two-channel downmix signal ($R_1$, $R_2$), which is associated with additional metadata, the additional metadata comprising additional upmix parameters ($\alpha_{RU}$) for parametric reconstruction of an additional M-channel audio signal (R, RS, RB, TFR, TBR) based on the additional downmix signal, wherein a first channel ($R_1$) of the additional downmix signal corresponds to a linear combination of a first group (403) of one or more channels of the additional M-channel audio signal, wherein a second channel ($R_2$) of the additional downmix signal corresponds to a linear combination of a second group (403) of one or more channels of the additional M-channel audio signal, and wherein the first and second groups of channels of the additional M-channel audio signal constitute a partition of the M channels of the additional M-channel audio signal, receive at least a portion of the additional metadata; and provide an additional two-channel output signal ($\widetilde{R_1}$, $\widetilde{R_2}$) based on the additional downmix signal and the additional received metadata, the additional decoding section comprising:

an additional decorrelating section configured to receive at least one channel of the additional downmix signal and to output, based thereon, an additional decorrelated signal; and an additional mixing section configured to determine a set of additional mixing coefficients based on the received additional metadata, and form the additional output signal as a linear combination of the additional downmix signal and the additional decorrelated signal in accordance with the additional mixing coefficients, wherein the additional mixing section is configured to determine the additional mixing coefficients such that:

a first channel ($\widetilde{R_1}$) of the additional output signal approximates a linear combination of a third group (503) of one or more channels of the additional M-channel audio signal;

a second channel ($\widetilde{R_2}$) of the additional output signal approximates a linear combination of a fourth group (504) of one or more channels of the additional M-channel audio signal;

the third and fourth groups of channels of the additional M-channel audio signal constitute a partition of the M channels of the additional M-channel audio signal; and both of the third and fourth groups of channels of the additional M-channel audio signal comprise at least one channel from said first group of channels of the additional M-channel audio signal.

26. The decoding system of any of examples 24-25, further comprising:

a demultiplexer (801) configured to extract, from a bitstream (B), the downmix signal, said received metadata, and a discretely coded audio channel (C); and a single-channel decoding section operable to decode said discretely coded audio channel.

27. An audio encoding method (300) comprising:

receiving (310) an M-channel audio signal (L, LS, LB, TFL, TBL), where M≥4;

computing (320) a two-channel downmix signal ($L_1$, $L_2$) based on the M-channel audio signal, a first channel ($L_1$) of the downmix signal being formed as a linear combination of a first group (401) of one or more channels of the M-channel audio signal, and a second channel ($L_2$) of the downmix signal being formed as a linear combination of a second group (402) of one or more channels of the M-channel audio signal, wherein the first and second groups constitute a partition of the M channels of the M-channel audio signal;

determining (330) upmix parameters ($\alpha_{LU}$) for parametric reconstruction of the M-channel audio signal from the downmix signal, determining (340) mixing parameters for obtaining, based on the downmix signal, a two-channel output signal ($\widetilde{L_1}$, $\widetilde{L_2}$), wherein a first channel ($\widetilde{L_1}$) of the output signal approximates a linear combination of a third group (501) of one or more channels of the M-channel audio signal, wherein a second channel ($\widetilde{L_2}$) of the output signal approximates a linear combination of a fourth group (502) of one or more channels of the M-channel audio signal, wherein the third and fourth groups constitute a partition of the M channels of the M-channel audio signal, and wherein both of the third and fourth groups comprise at least one channel from said first group; and outputting (350) the downmix signal and metadata for joint storage or transmission, wherein the metadata comprises the upmix parameters and the mixing parameters.

28. The audio encoding method of example 27, wherein the mixing parameters control respective contributions from the downmix signal and from a decorrelated signal to the output signal, wherein at least some of the mixing parameters are determined by minimizing a contribution from the decorrelated signal among such mixing parameters that cause the channels of the output signal to be covariance-preserving approximations of said linear combinations of the first and second groups of channels, respectively.

29. The audio encoding method of any of examples 27-28, wherein said first group consists of N channels, where N≥3, wherein at least some of the upmix parameters are suitable for parametric reconstruction of said first group from said first channel of the downmix signal and an (N−1)-channel decorrelated signal determined based on said first channel of the downmix signal, wherein determining the upmix parameters includes:

determining a set of dry upmix coefficients in order to define a linear mapping of said first channel of the downmix signal approximating said first group; and determining an intermediate matrix based on a difference between a covariance of said first group as received and a covariance of said first group as approximated by the linear mapping of said first channel of the downmix signal, wherein the intermediate matrix when multiplied by a predefined matrix corresponds to a set of wet upmix coefficients defining a linear mapping of said decorrelated signal as part of parametric reconstruction of said first group, wherein the set of wet upmix coefficients includes more coefficients than the number of elements in the intermediate matrix, wherein said upmix parameters include dry upmix parameters, from which the set of dry upmix coefficients is derivable, and wet upmix parameters uniquely defining the intermediate matrix provided that the intermediate matrix belongs to a predefined matrix class, wherein the intermediate matrix has more elements than the number of said wet upmix parameters.

30. The audio encoding method of any of examples 27-29, further comprising:

selecting one of at least two coding formats ($F_1$, $F_2$, $F_3$), the coding formats corresponding to respective different partitions of the channels of the M-channel audio signal into respective first and second groups associated with the channels of the downmix signal, wherein the first and second channels of the downmix signal are formed as linear combinations of a first and a second group of one or more channels, respectively, of the M-channel audio signal, in accordance with the selected coding format, and wherein the upmix parameters and the mixing parameters are determined based on the selected coding format, the method further comprising:

providing signaling indicating the selected coding format.

31. An audio encoding system (200) comprising an encoding section (100) configured to encode an M-channel audio signal (L, LS, LB, TFL, TBL) as a two-channel downmix signal ($L_1$, $L_2$) and associated metadata, where M≥4, and to output the downmix signal and metadata for joint storage or transmission, the encoding section comprising:

a downmix section (110) configured to compute the downmix signal based on the M-channel audio signal, a first channel ($L_1$) of the downmix signal being formed as a linear combination of a first group (401) of one or more channels of the M-channel audio signal, and a second channel ($L_2$) of the downmix signal being formed as a linear combination of a second group (402) of one or more channels of the M-channel audio signal, wherein the first and second groups constitute a partition of the M channels of the M-channel audio signal; and an analysis section (120) configured to determine upmix parameters ($\alpha_{LU}$) for parametric reconstruction of the M-channel audio signal from the downmix signal, and mixing parameters ($\alpha_{LM}$) for obtaining, based on the downmix signal, a two-channel output signal ($\widetilde{L_1}, \widetilde{L_2}$), wherein a first channel ($\widetilde{L_1}$) of the output signal approximates a linear combination of a third group (501) of one or more channels of the M-channel audio signal, wherein a second channel ($\widetilde{L_2}$) of the output signal approximates a linear combination of a fourth group (502) of one or more channels of the M-channel audio signal, wherein the third and fourth groups constitute a partition of the M channels of the M-channel audio signal, and wherein both of the third and fourth groups comprise at least one channel from said first group, wherein the metadata comprises the upmix parameters and the mixing parameters.

32. A computer program product comprising a computer-readable medium with instructions for performing the method of any of examples 1-23 and 27-30.

33. A computer-readable medium (1100) representing:

a two-channel downmix signal ($L_1$, $L_2$);

upmix parameters ($\alpha_{LU}$) allowing parametric reconstruction of an M-channel audio signal (L, LS, LB, TFL, TBL) based on the downmix signal, where M≥4, wherein a first channel ($L_1$) of the downmix signal corresponds to a linear combination of a first group (401) of one or more channels of the M-channel audio signal, wherein a second channel ($L_2$) of the downmix signal corresponds to a linear combination of a second group (402) of one or more channels of the M-channel audio signal, and wherein the first and second groups constitute a partition of the M channels of the M-channel audio signal; and mixing parameters ($\alpha_{LM}$) allowing provision of a two-channel output signal ($\widetilde{L_1}, \widetilde{L_2}$) based on the downmix signal, wherein a first channel ($\widetilde{L_1}$) of the output signal approximates a linear combination of a third group (501) of one or more channels of the M-channel audio signal, wherein a second channel ($\widetilde{L_2}$) of the output signal approximates a linear combination of a fourth group (502) of one or more channels of the M-channel audio signal, wherein the third and fourth groups constitute a partition of the M channels of the M-channel audio signal, and wherein both of the third and fourth groups comprise at least one channel from said first group.

34. The computer-readable medium of example 33, wherein data represented by the data carrier are arranged in time frames and are layered such that, for a given time frame, the downmix signal and associated mixing parameters for that time frame may be extracted independently of the associated upmix parameters.

The invention claimed is:

1. An audio decoding method comprising:

receiving a two-channel downmix signal, which is associated with metadata, the metadata comprising upmix parameters for parametric reconstruction of an M-channel audio signal based on the downmix signal, where M≥4;

receiving at least a portion of said metadata;

generating a decorrelated signal based on at least one channel of the downmix signal;

determining a set of mixing coefficients based on the received metadata; and forming a K-channel output signal as a linear combination of the downmix signal and the decorrelated signal in accordance with the mixing coefficients, wherein 2≤K<M, wherein the mixing coefficients are determined such that a sum of a mixing coefficient controlling a contribution from the first channel of the downmix signal to a channel of the output signal, and a mixing coefficient controlling a contribution from the first channel of the downmix signal to another channel of the output signal, has the value 1, wherein, if the downmix signal represents the M-channel audio signal according to a first coding format in which:

a first channel of the downmix signal corresponds to a certain linear combination of a first group of one or more channels of the M-channel audio signal;

a second channel of the downmix signal corresponds to a certain linear combination of a second group of one or more channels of the M-channel audio signal; and the first and second groups constitute a certain partition of the M channels of the M-channel audio signal, then the K-channel output signal represents the M-channel audio signal according to a second coding format in which:

each of the K channels of the output signal approximates a linear combination of a group of one or more channels of the M-channel audio signal;

the groups corresponding to the respective channels of the output signal constitute a partition of the M channels of the M-channel audio signal into K groups of one or more channels; and at least two of the K groups comprise at least one channel from said first group.

2. The audio decoding method of claim 1, wherein K=2, K=3 or K=4, and/or wherein M=5 or M=6.

3. The audio decoding method of claim 1, wherein the received metadata includes the upmix parameters and wherein the mixing coefficients are determined by processing the upmix parameters.

4. The audio decoding method of claim 1, wherein:

in the first coding format, each of the channels of the M-channel audio signal is associated with a non-zero gain controlling a contribution from this channel to one of the linear combinations to which the channels of the downmix signal correspond;

in the second coding format, each of the channels of the M-channel audio signal is associated with a non-zero gain controlling a contribution from this channel to one of the linear combinations approximated by the channels of the output signal; and for each of the channels of the M-channel audio signal, the non-zero gain associated with the channel in the first coding format coincides with the non-zero gain associated with the channel in the second coding format.

5. The audio decoding method of claim 1, further comprising an initial step of receiving a bitstream representing the downmix signal and the metadata, wherein the downmix signal and said received metadata are extracted from the bitstream.

6. The audio decoding method of claim 1, wherein the decorrelated signal is a two-channel signal, and wherein said output signal is formed by including no more than two decorrelated signal channels into said linear combination of the downmix signal and the decorrelated signal.

7. The audio decoding method of claim 6, wherein K=3, and wherein forming the output signal amounts to a projection from four channels to three channels.

8. The audio decoding method of claim 1, wherein said first group consists of two or three channels.

9. The audio decoding method of claim 1, wherein the M-channel audio signal comprises either three or four channels representing different horizontal directions in a playback environment for the M-channel audio signal, and two channels representing directions vertically separated from those of said three or four channels in said playback environment.

10. The audio decoding method of claim 9, wherein said first group consists of said three channels, and wherein said second group consists of the two channels representing directions vertically separated from those of said three channels in said playback environment.

11. The audio decoding method of claim 10, wherein the two channels representing directions vertically separated from those of said three channels in said playback environment are comprised in different groups of the K groups.

12. The audio decoding method of claim 9, wherein one of the K groups comprises both of the two channels representing directions vertically separated from those of said three or four channels in said playback environment.

13. The audio decoding method of claim 1, wherein the decorrelated signal comprises two channels, a first channel of the decorrelated signal being obtained based on the first channel of the downmix signal and a second channel of the decorrelated signal being obtained based on the second channel of the downmix signal.

14. The audio decoding method of claim 1, wherein said first group consists of N channels, where N≥3, wherein said first group is reconstructable as a linear combination of said first channel of the downmix signal and an (N−1) channel decorrelated signal by applying dry upmix coefficients to said first channel of the downmix signal and wet upmix coefficients to channels of the channel decorrelated signal, wherein the received metadata includes wet upmix parameters and dry upmix parameters, and wherein determining the mixing coefficients comprises:

determining, based on the dry upmix parameters, the dry upmix coefficients;

populating an intermediate matrix having more elements than the number of received wet upmix parameters, based on the received wet upmix parameters and knowing that the intermediate matrix belongs to a predefined matrix class;

obtaining the wet upmix coefficients by multiplying the intermediate matrix by a predefined matrix, wherein the wet upmix coefficients corresponds to the matrix resulting from the multiplication and includes more coefficients than the number of elements in the intermediate matrix; and processing the wet and dry upmix coefficients.

15. The audio decoding method of claim 1, further comprising:

signaling indicating one of at least two coding formats of the M-channel audio signal, the coding formats corresponding to respective different partitions of the channels of the M-channel audio signal into respective first and second groups associated with the channels of the downmix signal, wherein the K groups are predefined, and wherein the mixing coefficients are determined such that a single partition of the M-channel audio signal into the K groups of channels, approximated by the channels of the output signal, is maintained for said at least two coding formats.

16. The audio decoding method of claim 15, wherein:

in a first coding format of said at least two coding formats, said first group consists of three channels representing different horizontal directions in a playback environment for the M-channel audio signal, and said second group consists of two channels representing directions vertically separated from those of said three channels in said playback environment; and in a second coding format of said at least two coding formats, each of said first and second groups comprises one of said two channels representing directions vertically separated from those of said three channels in said playback environment.

17. A non-transitory computer readable storage medium comprising instructions, wherein the instructions, when executed by an audio signal processing device, cause the device to perform the method of claim 1.

18. An audio decoding system comprising a decoding section configured to:

receive a two-channel downmix signal, which is associated with metadata, the metadata comprising upmix parameters for parametric reconstruction of an M-channel audio signal based on the downmix signal, where M≥4;

receive at least a portion of said metadata; and provide a K-channel output signal based on the downmix signal and the received metadata, wherein 2≤K<M, the decoding section comprising:

a decorrelating section configured to receive at least one channel of the downmix signal and to output, based thereon, a decorrelated signal; and a mixing section configured to determine a set of mixing coefficients based on the received metadata, and form the output signal as a linear combination of the downmix signal and the decorrelated signal in accordance with the mixing coefficients, wherein the mixing section is configured to determine the mixing coefficients such that a sum of a mixing coefficient controlling a contribution from the first channel of the downmix signal to a channel of the output signal, and a mixing coefficient controlling a contribution from the first channel of the downmix signal to another channel of the output signal, has the value 1, wherein, if the downmix signal represents the M-channel audio signal according to a first coding format in which:

a first channel of the downmix signal corresponds to a certain linear combination of a first group of one or more channels of the M-channel audio signal;

a second channel of the downmix signal corresponds to a certain linear combination of a second group of one or more channels of the M-channel audio signal; and the first and second groups constitute a certain partition of the M channels of the M-channel audio signal, then the K-channel output signal represents the M-channel audio signal according to a second coding format in which:

each of the K channels of the output signal approximates a linear combination of a group of one or more channels of the M-channel audio signal;

the groups corresponding to the respective channels of the output signal constitute a partition of the M channels of the M-channel audio signal into K groups of one or more channels; and at least two of the K groups comprise at least one channel from said first group.

19. The audio decoding system of claim 18, further comprising an additional decoding section configured to:

receive an additional two-channel downmix signal, which is associated with additional metadata, the additional metadata comprising additional upmix parameters for parametric reconstruction of an additional M-channel audio signal based on the additional downmix signal, receive at least a portion of the additional metadata; and provide an additional K-channel output signal based on the additional downmix signal and the additional received metadata, the additional decoding section comprising:

an additional decorrelating section configured to receive at least one channel of the additional downmix signal and to output, based thereon, an additional decorrelated signal; and an additional mixing section configured to:

determine a set of additional mixing coefficients based on the received additional metadata, and form the additional output signal as a linear combination of the additional downmix signal and the additional decorrelated signal in accordance with the additional mixing coefficients, wherein the additional mixing section is configured to determine the additional mixing coefficients such that a sum of a mixing coefficient controlling a contribution from the first channel of the additional downmix signal to a channel of the additional output signal, and a mixing coefficient controlling a contribution from the first channel of the additional downmix signal to another channel of the additional output signal, has the value 1, wherein, if the additional downmix signal represents the additional M-channel audio signal according to a third coding format in which:

a first channel of the additional downmix signal corresponds to a linear combination of a first group of one or more channels of the additional M-channel audio signal; a second channel of the additional downmix signal corresponds to a linear combination of a second group of one or more channels of the additional M-channel audio signal; and the first and second groups of channels of the additional M-channel audio signal constitute a partition of the M channels of the additional M-channel audio signal, then the additional K-channel output signal represents the additional M-channel audio signal according to a fourth coding format in which:

each of the K channels of the additional output signal approximates a linear combination of a group of one or more channels of the M-channel audio signal;

the groups corresponding to the respective channels of the additional output signal constitute a partition of the M channels of the additional M-channel audio signal into K groups of one or more channels; and at least two of the K groups of one or more channels of the additional M-channel audio signal comprise at least one channel from said first group of channels of the additional M-channel audio signal.

20. The decoding system of claim 18, further comprising:

a demultiplexer configured to extract, from a bitstream, the downmix signal, said received metadata, and a discretely coded audio channel; and a single-channel decoding section operable to decode said discretely coded audio channel.

* * * * *